US006475253B2

(12) United States Patent
Culler et al.

(10) Patent No.: US 6,475,253 B2
(45) **Date of Patent: *Nov. 5, 2002**

(54) ABRASIVE ARTICLE AND METHOD OF MAKING

(75) Inventors: Scott R. Culler, Burnsville, MN (US); John J. Gagliardi, Hudson, WI (US); Thomas W. Larkey, Hugo, MN (US); Eric G. Larson, Lake Elmo, MN (US); Larry L. Martin, Maplewood, MN (US); Jeffrey W. Nelson, Bayport, MN (US)

(73) Assignee: 3M Innovative Properties Company, St. Paul, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/242,989

(22) PCT Filed: Sep. 11, 1996

(86) PCT No.: PCT/US96/14570

§ 371 (c)(1),
(2), (4) Date: Feb. 26, 1999

(87) PCT Pub. No.: WO98/10896

PCT Pub. Date: Mar. 19, 1998

(65) Prior Publication Data

US 2002/0026752 A1 Mar. 7, 2002

(51) Int. Cl.[7] ..... B24D 3/34

(52) U.S. Cl. ..... 51/295; 51/297; 51/298; 428/323

(58) Field of Search ..... 428/323, 325, 428/328, 329, 330, 331, 411.1, 413, 414, 422.8, 423.1, 500, 502, 515, 923; 451/526, 533, 539, 559; 205/109, 110; 51/297, 298, 307, 308, 309, 293, 295

(56) References Cited

U.S. PATENT DOCUMENTS

| | | | |
|---|---|---|---|
| 1,910,444 A | 5/1933 | Nicholson | |
| 2,958,593 A | 10/1960 | Hoover et al. | 51/295 |
| 3,041,156 A | 6/1962 | Rowse et al. | 51/298 |

(List continued on next page.)

FOREIGN PATENT DOCUMENTS

| | | | |
|---|---|---|---|
| EP | 0 109 581 A2 | | 5/1984 |
| EP | 0 119 498 A2 | | 9/1984 |
| EP | 0 306 161 A2 | | 3/1989 |
| EP | 0 400 658 A2 | | 12/1990 |
| EP | 0 486 308 A2 | | 5/1992 |
| EP | 0 306 162 B1 | | 10/1995 |
| FR | 2 507 101 | | 12/1982 |
| WO | WO 92/15626 | | 9/1992 |
| WO | WO 93/12911 | | 7/1993 |
| WO | WO 95/01241 | * | 1/1995 |
| WO | WO 95/13074 | | 5/1995 |
| WO | WO 95/20469 | * | 8/1995 |
| WO | WO 96/10471 | | 4/1996 |

OTHER PUBLICATIONS

Enc. of Poly. Sci. and Eng., 2nd Edition, vol. 1, pp. 36–41, 1985.*

*Primary Examiner*—Stevan A. Resan
*Assistant Examiner*—Kevin M. Bernatz
(74) *Attorney, Agent, or Firm*—Scott A. Bardell; Bradford B. Wright

(57) ABSTRACT

This invention pertains to a coated, bonded or non-woven abrasive article containing precisely shaped particles and a binder. These precisely shaped particles can contain abrasive grits, fillers, grinding aids and lubricants. The binder is preferably a mixture of a resole phenolic resin and a free radical curable resin, resulting in improved cutting and life span. Also disclosed is a method of forming the coated, bonded or non-woven abrasive article.

21 Claims, 3 Drawing Sheets

U.S. PATENT DOCUMENTS

| | | | | |
|---|---|---|---|---|
| 3,336,418 | A | | 8/1967 | Dill ..... 260/884 |
| 3,689,346 | A | | 9/1972 | Rowland ..... 156/245 |
| 3,924,286 | A | | 12/1975 | Miller ..... 15/114 |
| 4,311,489 | A | | 1/1982 | Kressner ..... 51/298 |
| 4,314,827 | A | | 2/1982 | Leitheiser et al. ..... 51/298 |
| 4,318,766 | A | | 3/1982 | Smith ..... 156/330 |
| 4,623,364 | A | | 11/1986 | Cottringer et al. ..... 51/309 |
| 4,627,127 | A | | 12/1986 | Dupre ..... 15/179 |
| 4,652,274 | A | | 3/1987 | Boettcher et al. ..... 51/298 |
| 4,735,632 | A | | 4/1988 | Oxman et al. ..... 51/295 |
| 4,744,802 | A | | 5/1988 | Schwabel ..... 51/309 |
| 4,751,138 | A | | 6/1988 | Tumey et al. ..... 428/323 |
| 4,770,671 | A | | 9/1988 | Monroe et al. ..... 51/293 |
| 4,799,939 | A | | 1/1989 | Bloecher et al. ..... 51/293 |
| 4,881,951 | A | | 11/1989 | Wood et al. ..... 51/309 |
| 4,903,440 | A | | 2/1990 | Larson et al. ..... 51/298 |
| 4,985,340 | A | | 1/1991 | Palazzotto et al. ..... 430/270 |
| 4,997,461 | A | | 3/1991 | Markhoff-Matheny et al. ..... 51/295 |
| 5,009,675 | A | | 4/1991 | Kunz et al. ..... 51/295 |
| 5,009,676 | A | | 4/1991 | Rue et al. ..... 51/309 |
| 5,011,508 | A | | 4/1991 | Wald et al. ..... 51/293 |
| 5,016,311 | A | | 5/1991 | Young et al. ..... 15/88.3 |
| 5,035,723 | A | | 7/1991 | Kalinowski et al. ..... 51/309 |
| 5,042,991 | A | | 8/1991 | Kunz et al. ..... 51/295 |
| 5,055,112 | A | | 10/1991 | Duncan et al. ..... 51/298 |
| 5,055,113 | A | | 10/1991 | Larson et al. ..... 51/298 |
| 5,090,968 | A | | 2/1992 | Pellow ..... 51/293 |
| 5,103,598 | A | | 4/1992 | Kelly ..... 51/295 |
| 5,152,917 | A | * | 10/1992 | Pieper et al. ..... 51/295 |
| 5,201,916 | A | | 4/1993 | Berg et al. ..... 51/293 |
| 5,213,591 | A | | 5/1993 | Celikkaya et al. ..... 51/293 |
| 5,236,472 | A | | 8/1993 | Kirk et al. ..... 51/298 |
| 5,366,523 | A | | 11/1994 | Rowenhorst et al. ..... 51/293 |
| 5,368,619 | A | | 11/1994 | Culler ..... 51/308 |
| 5,378,251 | A | * | 1/1995 | Culler et al. ..... 51/295 |
| 5,417,726 | A | | 5/1995 | Stout et al. ..... 51/293 |
| 5,435,816 | A | * | 7/1995 | Spurgeon et al. ..... 51/295 |
| 5,441,549 | A | | 8/1995 | Helmin ..... 51/298 |
| 5,486,219 | A | | 1/1996 | Ford et al. ..... 51/298 |
| 5,490,878 | A | * | 2/1996 | Peterson et al. ..... 51/295 |
| 5,496,386 | A | * | 3/1996 | Broberg et al. ..... 51/295 |
| 5,527,368 | A | | 6/1996 | Supkis et al. ..... 51/298 |
| 5,578,098 | A | * | 11/1996 | Gagliardi et al. ..... 51/296 |
| 5,681,217 | A | * | 10/1997 | Hoopman et al. ..... 451/528 |
| RE35,709 | E | | 1/1998 | Culler ..... 51/308 |

* cited by examiner

ABRASIVE ARTICLE AND METHOD OF MAKING

BACKGROUND OF THE INVENTION

1. Field of the Invention

This invention relates to particulate material comprising a binder, and a method for making same. When the particulate material further contains abrasive grits, it can be used in bonded abrasives, coated abrasives, and nonwoven abrasives.

2. Discussion of the Art

Conventional coated abrasive articles typically consist of a layer of abrasive grits adhered to a backing. Generally only a small fraction of the abrasive grits in this layer are actually utilized during the useful life of the coated abrasive article. A large proportion of the abrasive grits in this layer are wasted. Furthermore, the backing, one of the more expensive components of the coated abrasive article, must also be disposed of before it has worn out.

Many attempts have been made to distribute the abrasive grits on the backing in such a manner so that a higher percentage of abrasive grits are actually utilized, thereby extending the useful life of the coated abrasive article. By extending the life of the coated abrasive article, fewer belt or disc changes are required, thereby saving time and reducing labor costs. Merely depositing a thick layer of abrasive grits on the backing will not solve the problem, because grits lying below the topmost grits are not likely to be used.

Several methods whereby abrasive grits can be distributed in a coated abrasive article in such a way as to prolong the life of the article are known. One such way involves incorporating abrasive agglomerates in the coated abrasive article. Abrasive agglomerates consist of abrasive grits bonded together by means of a binder to form a mass. The use of abrasive agglomerates having random shapes and sizes makes it difficult to predictably control the quantity of abrasive grits that come into contact with the surface of a workpiece. For this reason, it would be desirable to have an economical way to prepare precisely shaped abrasive agglomerates.

SUMMARY OF THE INVENTION

This invention provides precisely shaped particles and methods for making these particles. The particles comprise a binder. In one desirable embodiment, a plurality of abrasive grits is dispersed in the binder.

The method of this invention comprises the steps of:

(a) providing a production tool having a three-dimensional body which has at least one continuous surface, the surface containing at least one opening formed in the continuous surface, with at least one opening providing access to a cavity in the three-dimensional body;

(b) providing a dispensing means capable of introducing a binder precursor comprising a thermosetting resin into said at least one cavity through said at least one opening;

(c) providing a means, within a curing zone, for at least partially curing said binder precursor;

(d) introducing said binder precursor into at least a portion of said at least one cavity;

(e) continuously moving said at least one cavity through said curing zone to at least partially cure said binder precursor to provide a solidified, handleable binder having a shape corresponding to that portion of the cavity into which the binder precursor had been introduced;

(f) removing said binder from said at least one cavity; and (g) converting said binder to form a precisely shaped particle.

Steps (f) and (g) can be conducted simultaneously.

In a preferred embodiment, a plurality of abrasive grits is included with the binder precursor in step (d), and a binder containing abrasive grits is formed in step (e). The binder that contains abrasive grits is removed from the at least one cavity of the production tool in step (f). Materials other than abrasive grits can be included with the binder precursor.

The curing zone can contain a source of thermal energy, a source of radiation energy, or both. Suitable sources of radiation energy include electron beam, visible light, and ultraviolet light. In a variation of the general method, curing can be effected by thermal energy or by a combination of radiation energy and thermal energy.

In both the general and preferred embodiments, it is preferred that steps (d), (e), and (f) be carried out on a continuous basis or be carried out in a continuous manner. For these embodiments, it is preferred that the production tool be an endless web (belt), or a drum, preferably a cylindrical drum, which will rotate about its axis. Alternatively, a web having two ends can be used. Such a two-ended web travels from an unwind station to a rewind station. It is preferred that the production tool have a plurality of cavities.

During step (e) of the method, the binder precursor is solidified so as to be converted into a handleable binder.

The binder can be converted into particles by several means. In one means, when the binder is removed from the cavities of the production tool, it is released in the form of individual particles. These particles can contain additional materials or be free of additional materials. A typical material that can be included in these particles is abrasive grits. The resulting particles preferably have shapes that are essentially the same as the shapes of the cavities of the production tool. Thus, the particles have shapes that are determined by the shapes of the cavities of the production tool. In this first means, steps (f) and (g) are accomplished simultaneously, because the shaped particles have their characteristic form when they are released from the cavities of the production tool.

In a second means, the binder is removed from the major surface of the production tool in the form of a sheet comprising shaped portions that are of essentially of the same size and shape of the cavities of the production tool, but joined together by a relatively thin connecting layer of the material of the binder. In this second means, the sheet is then broken or crushed along the thin connecting layer of binder material to form the particulate material of this invention. The particles can be screened or classified to remove any undesired particles. If the connecting layer of the binder material is carefully broken or crushed, the resulting particles can have shapes that are essentially the same as those of the cavities of the production tool.

It is also within the scope of this invention to use a carrier web to deliver binder precursor to the production tool. The binder precursor can be coated onto one major surface, e.g., the front surface, of a carrier web and then the resulting coated carrier web is brought into contact with the continuous surface of the production tool that contains the cavities. After at least partial curing, i.e., solidifying, of the binder precursor in the production tool, the binder, which preferentially adheres to the surface of the carrier web, is removed first from the production tool and then from the carrier web. Alternatively, the binder precursor is coated onto the continuous surface of the production tool having cavities, whereby such cavities are filled, and the carrier web is brought into contact with the continuous surface of the production tool containing the binder precursor in such a manner that the binder precursor contained in the cavities contacts the surface of the carrier web. After at least partial curing, i.e., solidifying, of the binder precursor, the binder adheres to the surface carrier web rather than to the production tool. The binder can then be removed from the carrier web. Subsequently, the precisely shaped particles are formed.

The precisely shaped particles can be modified by means of additives for use in abrading applications, either by themselves or as a component of an abrasive article. The particles of this invention can be used to prepare abrasive articles comprising a plurality of shaped particles, each of which comprises at least one abrasive grit and a binder, in which the binder is formed from a binder precursor comprising a thermosetting resin that can be cured by radiation energy or thermal energy or both. The particles can be bonded together to form a shaped mass, e.g., a wheel; alternatively, the particles can be bonded to a backing to form a coated abrasive article; or the particles can be bonded into a fibrous, nonwoven substrate to form a non-woven abrasive article.

This invention makes it possible to design particles suitable for specific applications by varying the shape and composition of the particles. The process of this invention provides a simple, fast, and economical method for manufacturing particles, especially abrasive particles having a precise shape. The process of this invention makes it possible to accurately make abrasive particles having the same dimensions from batch to batch, thereby leading to more consistent abrasive articles.

Another aspect of the invention pertains to a coated abrasive article, comprising:

(a) a backing having a front and back surface;

(b) a make coat present on the front surface of the backing;

(c) an abrasive layer bonded to the front surface of the backing by means of the make coat, wherein the abrasive layer comprises:

(1) a plurality of abrasive grits;

(2) a plurality of precisely shaped grinding aid particles, wherein the precisely shaped grinding aid particles comprise a binder and a plurality of grinding aid particulates; and (d) a size coat present over the abrasive layer.

In general, it is preferred that the surface area of the abrasive layer comprises 5 to 90 percent, preferably 10 to 75 percent, most preferably 20 to 40 percent precisely shaped grinding aid particles.

Another aspect of the invention pertains to a bonded abrasive article, comprising:

(a) a bonding medium;

(b) a plurality of abrasive grits;

(c) a plurality of precisely shaped grinding aid particles, wherein the precisely shaped grinding aid particles comprise a binder and a plurality of grinding aid particulates; and wherein the bonding medium serves to bond the abrasive grits and precisely shaped grinding aid particles together to form a shaped mass.

It is preferred that the bonded abrasive is in the form of a wheel, including a cut off wheel. In general, the volume percent of the precisely shaped grinding aid particles in a bonded abrasive ranges from about 5 to 85 percent, preferably between 5 to 75 percent, more preferably between 5 to 60 percent and most preferably between 10 to 60 percent.

The precisely shaped grinding aid particles may further comprise abrasive grits. The abrasive grits will generally have a Moh hardness greater than about 8. However, it is generally preferred that the precisely shaped grinding aid particles consist essentially of the binder and grinding aid particulates.

Still another aspect of the invention pertains to a precisely shaped abrasive particle, comprising:

(a) a binder, wherein the binder is formed from a binder precursor comprising a resole phenolic resin and a free radically curable resin;

(b) a plurality of abrasive grits distributed in the binder to form the precisely shaped abrasive particle.

This type of precisely shaped abrasive particle can be incorporated into a coated abrasive article, a bonded abrasive article or a nonwoven abrasive article.

A further aspect of the invention pertains to an abrasive article comprising:

(a) a bonding medium, wherein the bonding medium having a plurality of precisely shaped filler particles distributed in a cured resinous adhesive, wherein the precisely shaped filler particles comprise a plurality of filler particles distributed in a binder;

(b) a plurality of abrasive grits, wherein the bonding medium serves at least one of the following functions:

(1) to bond the abrasive grits to a backing;

(2) to bond the abrasive grits into and onto a nonwoven substrate; and (3) to bond the abrasive grits together to form a shaped mass.

Another perspective of the invention pertains to a coated abrasive article, comprising:

(a) a backing having a front and back surface;

(b) a make coat present on the front surface of the backing;

(c) a plurality of abrasive grits bonded to the front surface of the backing by means of the make coat; and (d) a size coat present over the abrasive grits, wherein at least one of the make or size coats comprises a plurality of precisely shaped filler particles distributed in a cured resinous adhesive, wherein the precisely shaped filler particles comprise a plurality of filler particles distributed in a binder.

DETAILED DESCRIPTION OF THE INVENTION

As used herein, the expression "binder precursor" means any material that is conformable or can be made to be conformable by heat or pressure or both and that can be rendered non-conformable by means of radiation energy or thermal energy or both. As used herein, the expression "solidified, handleable binder" means a binder precursor that has been polymerized or cured to such a degree that it will not substantially flow or experience a substantial change in shape. The expression "solidified, handleable binder" does not mean that the binder precursor is always fully polymerized or cured, but that it is sufficiently polymerized or cured to allow removal thereof from the production tool while the production tool continues to move, without leading to substantial change in shape of the binder. After the binder is removed from the production tool, the binder can be exposed to an additional energy source to provide additional cure or polymerization of the binder. As used herein, the term "binder" is synonymous with the expression "solidified, handleable binder".

In one aspect, this invention involves a method of making a particulate material. In another aspect, this invention involves precisely shaped particles comprising a solidified, handleable binder. The term "precisely shaped" means that the binder precursor is cured, polymerized or solidified in a cavity of a production tool. After the binder precursor is solidified in the cavity, the resulting solidified binder is removed from the cavity. In some instances during this removal process, a particle is formed and during the removal process, edges of the particle may break. Additionally, when the particles are removed from the cavities, two, three or more particles may be interconnected at a common edge or otherwise remain together. In other instances, a sheet of particles is removed and then this sheet is further processed (e.g., crushing, breaking, ball milling and the like) to form individual particles. During this process of forming individual particles from a sheet of particles, the resulting individual particles may have rounded edges and/or several (i.e., two, three, four or more particles may remain together). It is within the scope of this invention, that the term "precisely shaped" covers both broken edge particles and rounded edge particles. Additionally it is within the scope of this invention, that the term "precisely shaped" covers two, three, four or more individual particles that interconnect or otherwise remain together.

In still another aspect, this invention involves abrasive articles, such as bonded abrasive articles, coated abrasive articles, and nonwoven abrasive articles that comprise the precisely shaped particulate material of this invention.

Figure 1:
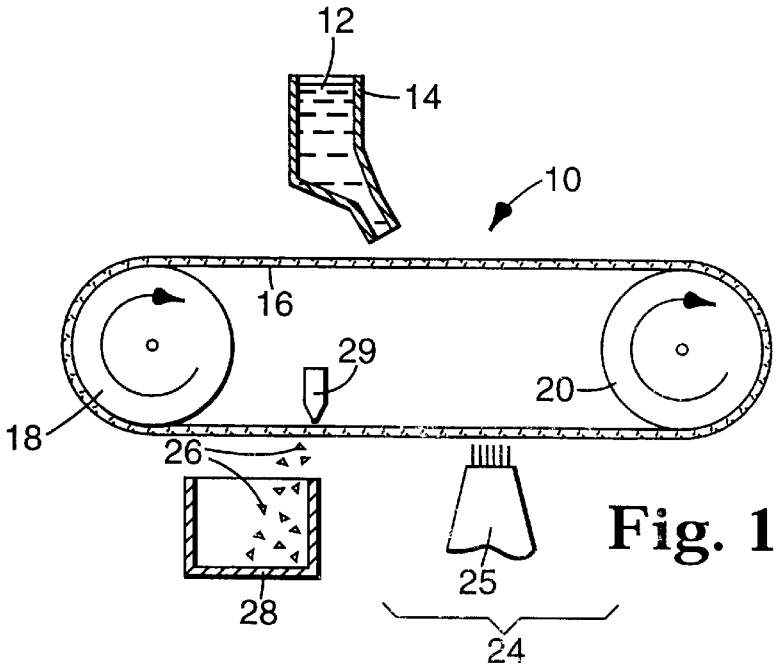
FIGS. 1, 2, and 3 are schematic side views illustrating various methods of carrying out the process of this invention.
Figure 6:
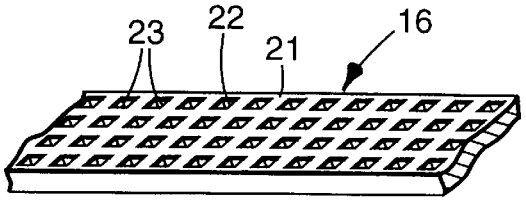
FIG. 6 is a perspective view of a segment of the production tool of FIG. 1. The segment illustrated in FIG. 6 is substantially similar to segments of the production tools of FIGS. 1, 2, and 3.

FIG. 1 illustrates an apparatus capable of carrying out the method of this invention to make the particles of this invention. In apparatus 10, binder precursor 12 is fed by gravity from a hopper 14 onto a production tool 16, which is in the form of an endless belt. The belt 16 travels over two rolls 18, 20, at least one of which is power driven. FIG. 6 is a perspective view of a segment of the production tool 16. As can be seen in FIG. 6, the production tool 16 is a three-dimensional body having a continuous surface 21 containing an opening 22 that provides access to a cavity 23 in the three-dimensional body. The binder precursor 12 fills at least a portion of cavity 23. The binder precursor 12 then travels through a curing zone 24 where it is exposed to an energy source 25 to at least partially cure the binder precursor 12 to form a solidified, handleable binder. Particles of precisely shaped binder material 26 are removed from the production tool 16 and collected in a container 28. External means 29, e.g., ultrasonic energy, can be used to help release the particles of binder material 26 from the production tool 16. Debris left in the production tool can be cleaned away before any fresh binder precursor is fed to the production tool.

Figure 2:
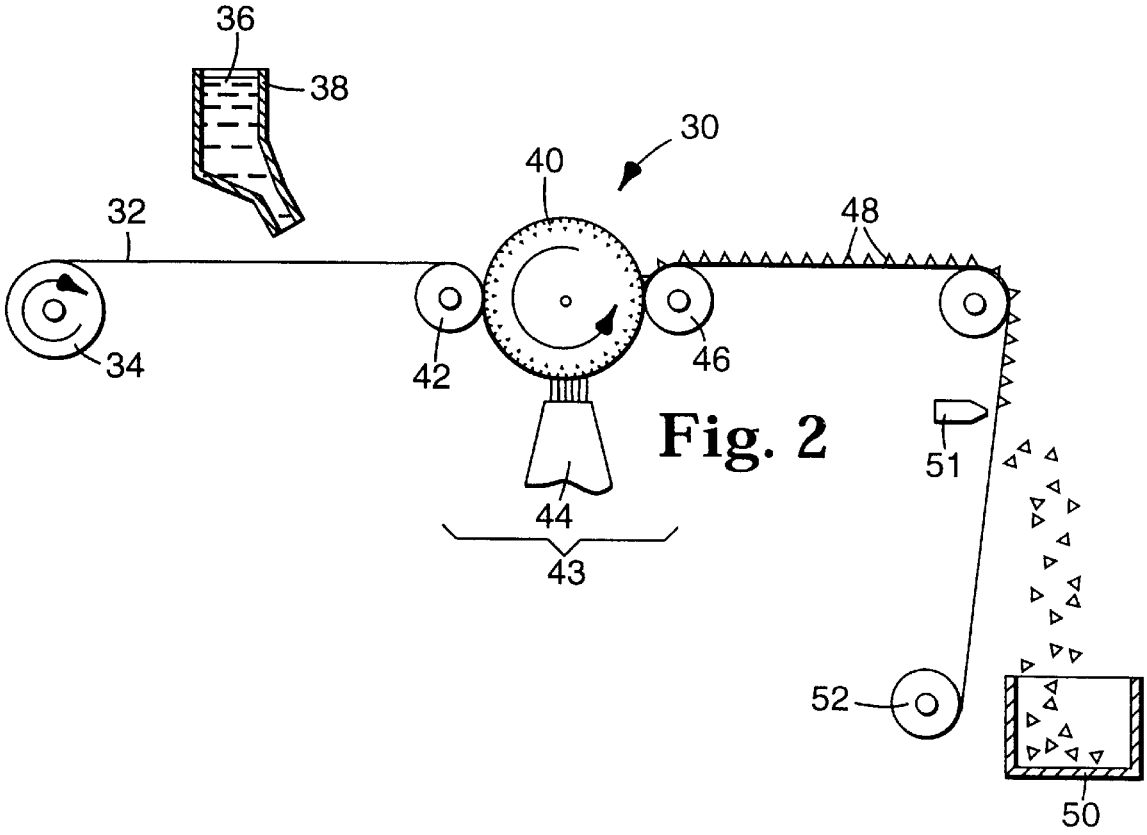

FIG. 2 illustrates another variation of apparatus capable of carrying out the method of this invention. Apparatus 30 comprises a carrier web 32 which is fed from an unwind station 34. Unwind station 34 is in the form of a roll. The carrier web 32 can be made of a material such as paper, cloth, polymeric film, nonwoven web, vulcanized fibre, combinations thereof and treated versions thereof. The preferred material for the carrier web 32 is a polymeric film, such as, for example, a polyester film. In FIG. 2, the carrier web 32 is transparent to radiation. A binder precursor 36 is fed by gravity from a hopper 38 onto a major surface of the carrier web 32. The major surface of the carrier web 32 containing the binder precursor 36 is forced against the surface of a production tool 40 by means of a nip roll 42. The surface of the production tool 40 that contacts the carrier web is curved, but it is otherwise identical to that of the segment of the production tool shown in FIG. 6. The nip roll 42 also aids in forcing the binder precursor 36 into the cavities of the production tool 40. The binder precursor 36 then travels through a curing zone 43 where it is exposed to an energy source 44 to at least partially cure the binder precursor 36 to form a solidified, handleable binder. Next, the carrier web 32 containing the solidified, handleable binder is passed over a nip roll 46. There must be sufficient adhesion between the carrier web 32 and the solidified, handleable binder in order to allow for subsequent removal of the binder from the cavities of the production tool 40. The particles of binder material 48 are removed from the carrier web 32 and collected in a container 50. External means 51, e.g., ultrasonic energy, can be used to help release the particles 48 from the carrier web 32. The carrier web 32 is then recovered at rewind station 52 so that it can be reused. Rewind station 52 is in the form of a roll.

Removal of the particles of binder material from the carrier web can be carried out efficiently by an alternative method. In this alternative, the carrier web can contain a thin, water-soluble layer on the major surface thereof that receives the binder precursor 36 from the hopper 38. The water-soluble layer will come into contact with the binder precursor 36. After the binder precursor 36 is at least partially cured, the combination of carrier web 32 and solidified, handleable binder is subjected to a source of water, whereby the water dissolves the water-soluble layer on the carrier web 32, thereby bringing about separation of the particles of binder material from the carrier web 32. An example of a water-soluble layer useful for this variation is a layer of a water-soluble polymer, e.g., polyvinyl alcohol, polyvinyl pyrrolidone, and cellulose derivatives.

Figure 3:
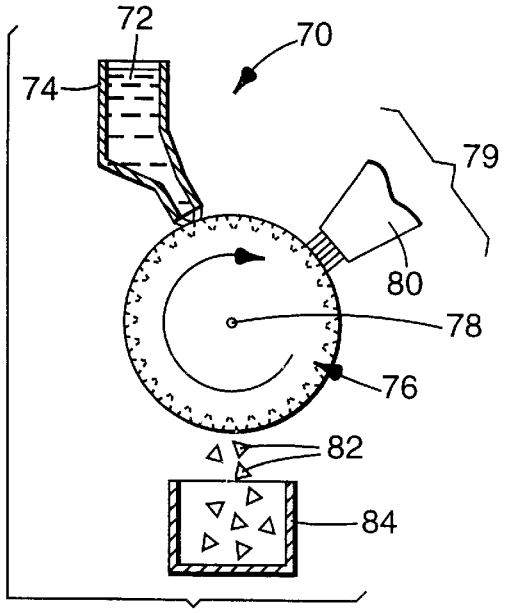

FIG. 3 illustrates another variation of an apparatus capable of carrying out the method of this invention. In apparatus 70, binder precursor 72 is knife coated from a hopper 74 onto a production tool 76. The production tool is in the form of a cylindrical drum and has an axis 78 The continuous surface of the production tool 76 is curved, but it is otherwise identical to the segment of the production tool shown in FIG. 6. As the production tool 76 rotates about the axis 78, the binder precursor 72 travels through a curing zone 79 where it is exposed to an energy source 80 to at least partially cure the binder precursor 72 to form a solidified, handleable binder. Next, the particles of solidified, handleable binder 82 resulting from the curing step of the process are removed from the production tool 76 and collected in a hopper 84. Removal is preferably carried out by mechanical means, e.g., a water jet. It is preferred that any debris remaining in the production tool 76 be removed before any fresh binder precursor is introduced. Debris removal can be accomplished by a brush, an air jet, or any other conventional technique. Although not shown in FIG. 3, additional means can be used to aid in removing the particles of binder from the production tool 76.

Figure 7:
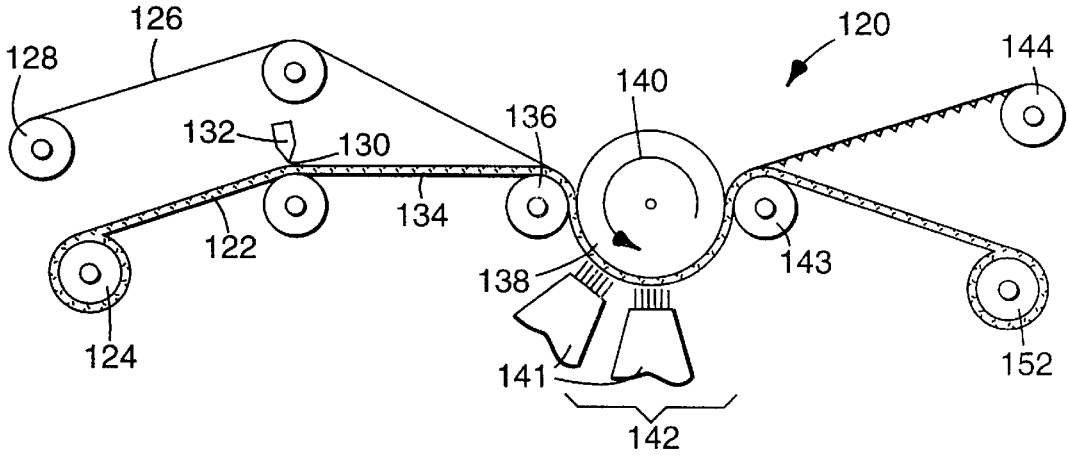
FIGS. 7 and 8 are schematic side views illustrating other methods of carrying out the process of this invention.

FIG. 7 illustrates another variation of an apparatus capable of carrying out the method of this invention. Apparatus 120 comprised a production tool 122 in the form of web, which was fed from a first unwind station 124. Unwind station 124 was in the form of a roll. The production tool 122 is preferably made of a polymeric material that was transparent to radiation, more preferably transparent to ultraviolet and/or visible light. For example, the production tool can be made of a polymer having a polyethylene backbone and fluoroaliphatic groups attached thereto. This polymer is further described in WO 92/15626, published Sep. 17, 1990. The ethylene polymer is bonded to polyester. The production tool can comprise a pattern of cavities in the form of pyramids having square bases and disposed such that the bases were butted up against each other. The surface of the production tool containing the cavities can be similar to the segment of the production tool shown in FIG. 6 The production tool 122 leaves the unwind station 124, a carrier web 126 leaves a second unwind station 128. The carrier web 126 can be made of a polyvinyl alcohol coated paper, commercially available from Schoeller Technical Papers, Inc. of Pulaski, New York; stock number 89-84-4. A binder precursor 130 is applied by means of a coater 132 into the cavities of the production tool 122. The portion of the production tool 134 containing the binder precursor is brought into contact with the carrier web 126 by means of a nip roll 136. The portion of the production tool 134 containing the binder precursor and the carrier web 126 is forced against a mandrel 138. The mandrel 138 rotates about an axis 140. Next, radiation energy from radiation source 141 in a curing zone 142 is transmitted through the production tool 122 and into the binder precursor. The source of radiation energy can be a medium pressure mercury vapor ultraviolet lamp operating at 600 watts/inch (240 watts/cm). Upon exposure to the energy source, the binder precursor is converted into a solidified, handleable binder. Both the production tool containing the solidified, handleable binder and the carrier web are continuously moved through the curing zone 142 by means of the mandrel 138. The carrier web 126 is separated from the production tool containing the binder in the vicinity of a nip roll 143. The carrier web 126 is rewound on a rewind station 144. Relative to FIG. 7, it is also within the scope of this invention to use an ultrasonic horn on the backside of the carrier web to facilitate the removal of the particles from the carrier web. In general, it is preferred that the ultrasonic horn be placed tightly against the back side of the carrier web, while the carrier web is under tension. An example of a commercially available ultrasonic horn commercially available from Branson under the model number "108".

Figure 8:
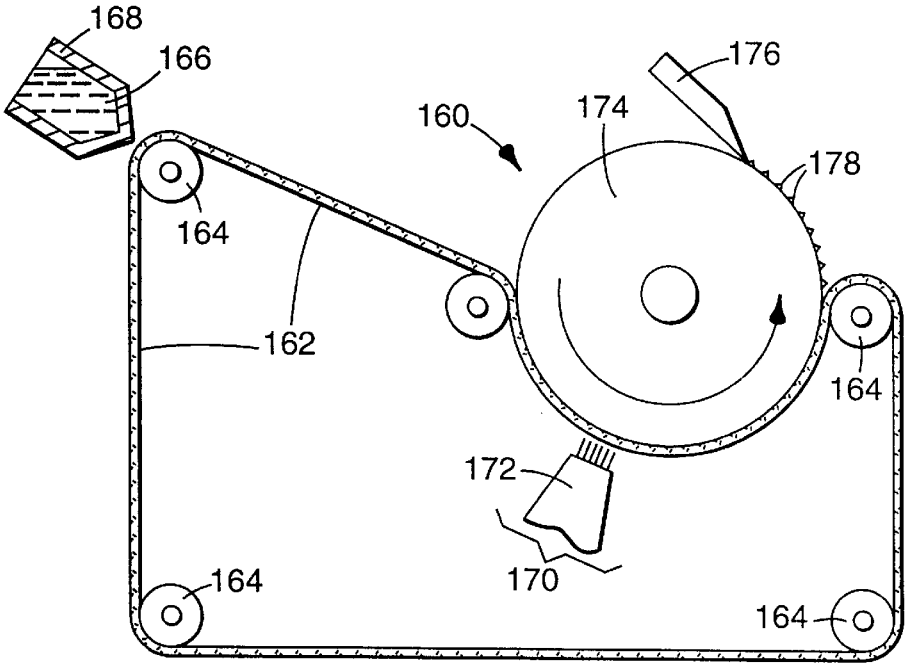

FIG. 8 illustrates another variation of an apparatus capable of carrying out the method of this invention. Apparatus 160 comprised a production tool 162 in the form of an endless belt, which traversed a series of rollers 164, at least one of which is power-driven. A binder precursor 166 is applied by means of a knife coater 168 into the cavities of the production tool 162. The binder precursor 166 then travels through a curing zone 170 where it is exposed to a source of radiation energy 172. The source of radiation energy can be a medium pressure mercury vapor ultraviolet lamp operating at 600 watts/inch (240 watts/cm). The process is continuous and upon exposure to the energy source 172, the binder precursor 166 is converted into a solidified, handleable binder The particles of binder 178 preferentially should adheres to a smooth-surfaced roll 174. Immediately after leaving the curing zone 170, the particles 178 are removed from the smooth-surfaced roll 174 by a skiving means 176 and collected by means of vacuum (not shown).

The production tool is a three-dimensional body having at least one continuous surface. The continuous surface contains at least one opening, preferably a plurality of openings, formed in the continuous surface. Each opening provides access to a cavity formed in the three-dimensional body. As used in this context, the term "continuous" means characterized by uninterrupted extension in space; the openings and cavities are features in the continuous surface, but they do not break the surface into a plurality of individual surfaces. The production tool can be in the form of a web, a belt, e.g., an endless belt, a sheet, a coating roll, or a sleeve mounted on a coating roll. It is preferred that the production tool be one that allows continuous operations, such as, for example, an endless belt or a cylindrical coating roll that rotates about an axis. Typically, a cylindrical coating roll is in the form of a right cylinder, has a diameter of from about 25 to about 45 cm, and is constructed of a rigid material. Apparatus utilizing a two-ended web can also be adapted to provide continuous operations. The preferred materials for a production tool are polymers, such as polyolefins, e.g., polypropylene, or metals, such as nickel. The production tool can also be formed from a ceramic material.

A production tool made of metal can be fabricated by engraving, photolithography, hobbing, etching, knurling, assembling a plurality of metal parts machined in the desired configuration, die punching, or other mechanical means, or by electroforming. The preferred method for preparing a metal production tool or master tool is diamond turning. Another preferred technique for making the master tool and/or a metal production tool is to use a cutting knurl process. This cutting knurl process is further described in PCT Patent Application No. PCT/US95/13074. For example, a cylindrical, eight inch diameter, 28 inch long, 1026 mild steel workpiece was first plated with a thin layer of bright nickel to prevent corrosion and improve adhesion to plated copper. Next, 0.050 in. of hard copper, 240 knoop, was plated over the bright nickel. One end of the plated workpiece was mounted in a four jaw chuck and the other end supported with a center in the tail stock of a Clausing engine lathe equipped with a low pressure pump and water-based coolant. The workpiece outer surface was faced off smooth, leaving 0.030 in. of hard copper.

A Zeus Cut-Knurling Tool Model No. 209 was provided with a high speed steel ("HSS") first knurling wheel in the top position. First knurling wheel had a 30° left tooth incline relative to the axis of the wheel, 36 teeth per inch ("TPI"), with the teeth having a 90° included angle at the tooth ridge. The tool was also provided with a HSS second knurling wheel in the bottom position. The second knurling wheel had a 0° tooth incline angle relative to the wheel axis, 36 TPI, with a 90° included angle at the tooth ridge. Both wheel orientations were adjusted by setting the wheel mounting posts to the 200 mm (7.9 inch) workpiece O. D. position. The wheel axes were each approximately 30° relative to the horizontal center plane of the Zeus Cut-Knurling Tool. The Cut-Knurling Tool was then mounted on the cross slide of the Clausing lathe. The height of the tool was adjusted so that both wheels would contact the workpiece at the same time. The first wheel in the top position was then removed. Coolant flow was directed at the second wheel to wash away chips as they formed.

1) Second wheel was engaged with the workpiece. The lathe rotated the workpiece in a first direction (surface engaged with second wheel traveling upward) at 80 rpm with a tool feed rate parallel to the axis of the workpiece of 0.010 inch/revolution from right to left. The depth of cut of the first wheel was adjusted to give about 75% of a full depth knurl.

2) The second wheel was then removed and the first wheel was reinstalled in the top position. The lathe rotated the workpiece in a record direction (surface engaged with first wheel traveling downward) at the same conditions as above with tool direction from right to left parallel to the workpiece axis.

3) The first wheel was removed, and the second wheel was reinstalled in the bottom position. This third step repeated the first step, except the tool was adjusted to provide full knurl depth.

4) The second wheel was removed, and the first wheel was reinstalled in the top position. This fourth step repeated the second step, except the tool was adjusted to provide full knurl depth.

5) The first wheel was removed and the second wheel was reinstalled in the bottom position. This fifth step repeated the third step again at full knurl depth.

The resulting knurled workpiece surface was covered with a knurl pattern of 36.7 square-based pyramids per inch measured in the direction parallel to an edge of the base of the pyramid, having an average height of 0.0099 inches. The tops of the pyramids were rounded corresponding to the rounded valley of the knurl wheels. The peaks of the pyramidal pattern had a 11.5° helix angle with respect to a plane perpendicular to the longitudinal axis of the workpiece. The workpiece was coated with a protective layer of electroless nickel to prevent corrosion and improve polymer release characteristics before use.

The knurled workpiece described above was used to make a production tooling. First the workpiece and a nip roll were installed below an extruder. The knurled workpiece was held at 60° C. (140° F.) and the nip roll at 21° C. (70° F.). Escorene "Polypropylene 3445" at 214° C. (417° F.) was extruded on to the knurled workpiece and forced between the workpiece and nip roll as the workpiece and nip roll were rotated. A 0.022 inch thick seamless film was collected at 3.6 meters/minute (11.8 fpm). The surface of the film had an uninterrupted pattern of pyramidal pockets on its surface which were the inverse of those on the knurled workpiece.

Extruding techniques are further described in the *Encyclopedia of Polymer Science and Technology*, Vol. 8, John Wiley & Sons, Inc. (1968), p. 651–665, and U.S. Pat. No. 3,689,346, col. 7, lines 30 to 55. The production tool may also contain a release coating to permit easier removal of the binder from the cavities and to minimize wear of the production tool. Examples of such release coatings include hard coatings such as metal carbides, metal nitrides, metal borides, diamond, or diamond-like carbon. It is also within the scope of this invention to use a heated production tool, which is preferably made from metal. A heated tool may allow easier processing, more rapid curing, easier release of the shaped particles from the tool. Further information on production tools can be found in U.S. Pat. No. 5,435,816.

In some instances, a polymeric production tool can be replicated from an original master tool. This is especially preferred when the production tool is in the form of a belt or web. One advantage of polymeric tools over metal tools is cost. Another advantage of polymeric tools is the capability of allowing radiation to pass from the radiation source through the production tool and into the binder precursor. A polymeric production tool can be prepared by coating a molten thermoplastic resin, such as polypropylene, onto the master tool. The molten resin can then be quenched to give a thermoplastic replica of the master tool. This polymeric replica can then be utilized as the production tool. Additionally, the surface of the production tool may contain a release coating, such as a silicone-based material or a fluorochemical-based material, to improve the releasability of the binder from the production tool. It is also within the scope of this invention to incorporate a release agent into the polymer from which the production tool is formed. Typical release agents include silicone-based materials and fluorochemical-based materials. It is within the scope of this invention to prepare production tools from polymers that exhibit good release characteristics. Such a polymer is described in WO 92/15626, published Sep. 17, 1992. That reference describes a fluorochemical graft copolymer comprising: a base polymer comprising polymerized units derived from monomers having terminal olefinic double bonds, having a moiety comprising a fluoroaliphatic group grafted thereto. The grafted fluoroaliphatic group is generally derived from a fluorochemical olefin comprising a fluoroaliphatic group and a polymerizable double bond.

The fluoroaliphatic group of the fluorochemical olefin is generally bonded to the polymerizable double bond through a linking group. Such fluorochemical olefins can be represented by the following formula:

$$(R_f)_aQ(CR{=}CH_2)_b$$

wherein R represents hydrogen, trifluoromethyl, or straight-chain or branched-chain alkyl group containing 1 to 4 carbon atoms;

a represents an integer from 1 to 10;

b represents an integer from 1 to 6;

Q represents an (a+b)-valent linking group that does not substantially interfere with free radical polymerization; and $R_f$ represents a fluoroaliphatic group comprising a fully fluorinated terminal group containing at least seven fluorine atoms.

The metal master tool can be made by the same methods that can be used to make metal production tools. Other methods of preparing production tools are described in U.S. Pat. No. 5,435,816.

If the production tool is made from a thermoplastic material, the conditions of the method should be set such that any heat generated in the curing zone does not adversely affect the production tool.

At least one continuous surface of the production tool contains at least one cavity, preferably a plurality of cavities. The solidified, handleable binder precursor will acquire a shape corresponding to the shape of the cavity. A cavity can have any geometric shape such as a pyramid, prism, cylinder, cone, or thin body having opposed polygonal faces. The geometric shapes can be truncated versions of the foregoing. It is also within the scope of this invention that a given production tool may contain a variety of cavities of different shapes or cavities of different sizes or both. In the case of a web or belt, the cavity can extend completely through the production tool. The cavities can abutt or have land areas between them. It is preferred that the sides of the cavities have a slope associated them to allow easier removal of the binder from the production tool.

It is also within the scope of this invention that the cavity may have other geometric shapes such as a cube, block, sphere and the like.

The cavities may all be the same shape with the same dimensions. In this instance, the plurality of precisely shaped particles will all have essentially the same size and shape. Alternatively, the cavities may all be the same shape with different dimensions. In this instance, there will be a particle size distribution of precisely shaped particles. In yet another aspect, the cavities may all be the same dimensions, with different shapes. In this instance, the resulting precisely shaped particles will be the same size, with different shapes. In still another embodiment, the cavities may have different shapes and different sizes. In this instance, the resulting precisely shaped particles will have different shapes and sizes.

Binder precursors suitable for this invention comprise a thermosetting resin that is capable of being cured by radiation energy or thermal energy. The binder precursor can polymerize via a condensation curing mechanism or an addition mechanism. The preferred binder precursors polymerize via an addition mechanism. The binder precursor can polymerize via a free radical mechanism or a cationic mechanism or both mechanisms. The binder precursor can be unfilled or can contain conventional filler material.

The binder precursor is preferably capable of being cured by radiation energy or thermal energy. Sources of radiation energy include electron beam energy, ultraviolet light, visible light, and laser light. If ultraviolet or visible light is utilized, a photoinitiator is preferably included in the mixture. Upon being exposed to ultraviolet or visible light, the photoinitiator generates a free radical source or a cationic source. This free radical source or cationic source then initiates the polymerization of the binder precursor. A photoinitiator is optional when a source of electron beam energy is utilized.

Examples of binder precursors that are capable of being cured by radiation energy include acrylated urethanes, acrylated epoxies, ethylenically unsaturated compounds, aminoplast derivatives having pendant unsaturated carbonyl groups, isocyanurate derivatives having at least one pendant acrylate group, isocyanate derivatives having at least one pendant acrylate group, vinyl ethers, epoxy resins, and combinations thereof. The term acrylate includes both acrylates and methacrylates.

Acrylated urethanes are diacrylate esters of hydroxy terminated isocyanate extended polyesters or polyethers. Examples of commercially available acrylated urethanes include "UVITHANE 782", available from Morton Thiokol Chemical, and "CMD 6600", "CMD 8400", and "CMD 8805", available from Radcure Specialties.

Acrylated epoxies are diacrylate esters of epoxy resins, such as the diacrylate esters of bisphenol A epoxy resin. Examples of commercially available acrylated epoxies include "CMD 3500", "CMD 3600", and "CMD 3700", available from Radcure Specialties.

Ethylenically unsaturated compounds include both monomeric and polymeric compounds that contain atoms of carbon, hydrogen and oxygen, and optionally, nitrogen and the halogens. Oxygen or nitrogen atoms or both are generally present in ether, ester, urethane, amide, and urea groups. Ethylenically unsaturated compounds preferably have a molecular weight of less than about 4,000 and are preferably esters resulting from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of acrylates include methyl methacrylate, ethyl methacrylate, ethylene glycol diacrylate, ethylene glycol methacrylate, hexanediol diacrylate, triethylene glycol diacrylate, trimethylolpropane triacrylate, glycerol triacrylate, pentaerthyitol triacrylate, pentaerythritol methacrylate, and pentaerythritol tetraacrylate. Other ethylenically unsaturated compounds include monoallyl, polyallyl, and polymethylallyl esters and amides of carboxylic acids, such as diallyl phthalate, diallyl adipate, and N,N-diallyladipamide. Still other ethylenically unsaturated compounds include styrene, divinyl benzene, and vinyl toluene. Other nitrogen-containing, ethylenically unsaturated compounds include tris(2-acryloyl-oxyethyl) isocyanurate, 1,3,5-tri(2-methyacryloxyethyl)-s-triazine, acrylamide, methylacrylamide, N-methylacrylamide, NN-dimethylacrylamide, N-vinylpyrrolidone, and N-vinylpiperidone.

The aminoplast can be monomeric or oligomeric. The aminoplast resins have at least one pendant $\alpha,\beta$-unsaturated carbonyl group per molecule. These $\alpha,\beta$-unsaturated carbonyl groups can be acrylate, methacrylate, or acrylamide groups. Examples of such resins include N-hydroxymethylacrylamide, N,N'-oxydimethylenebisacrylamide, ortho and para acrylamidomethylated phenol, acrylamidomethylated phenolic novolac, and combinations thereof. These materials are further described in U.S. Pat. Nos. 4,903,440; 5,055,112 and 5,236,472.

Isocyanurate derivatives having at least one pendant acrylate group and isocyanate derivatives having at least one pendant acrylate group are further described in U.S. Pat. No. 4,652,274. The preferred isocyanurate material is a triacrylate of tris(hydroxyethyl) isocyanurate.

Examples of vinyl ethers suitable for this invention include vinyl ether functionalized urethane oligomers, commercially available from Allied Signal under the trade designations "VE 4010", "VE 4015", "VE2010", "VE 2020", and "VE 4020".

Epoxies have an oxirane ring and are polymerized by the ring opening. Epoxy resins include monomeric epoxy resins and polymeric epoxy resins. These resins can vary greatly in the nature of their backbones and substituent groups. For example, the backbone may be of any type normally associated with epoxy resins and substituent groups thereon can be any group free of an active hydrogen atom that is reactive with an oxirane ring at room temperature. Representative examples of substituent groups for epoxy resins include halogens, ester groups, ether groups, sulfonate groups, siloxane groups, nitro groups, and phosphate groups. Examples of epoxy resins preferred for this invention include 2,2-bis [4-(2,3-epoxypropoxy)phenyl]propane (diglycidyl ether of bisphenol A) and materials under the trade designation "Epon 828", "Epon 1004" and "Epon 1001F", commercially available from Shell Chemical Co., "DER-331", "DER-332" and "DER-334", commercially available from Dow Chemical Co. Other suitable epoxy resins include glycidyl ethers of phenol formaldehyde novolac (e.g., "DEN-43 " and "DEN-428", commercially available from Dow Chemical Co.). The epoxy resins of the invention can polymerize via a cationic mechanism with the addition of an appropriate photoinitiator(s). These resins are further described in U.S. Pat. Nos. 4,318,766 and 4,751,138.

Examples of photoinitiators that generate a free radical source when exposed to ultraviolet light include, but are not limited to, those selected from the group consisting of organic peroxides, azo compounds, quinones, benzophenones, nitroso compounds, acyl halides, hydrozones, mercapto compounds, pyrylium compounds, triacrylimidazoles, bisimidazoles, chloroalkytriazines, benzoin ethers, benzil ketals, thioxanthones, and acetophenone derivatives, and mixtures thereof. Examples of photoinitiators that generate a free radical source when exposed to visible radiation are described in U.S. Pat. No. 4,735,632.

Cationic photoinitiators generate an acid source to initiate the polymerization of an epoxy resin or a urethane. Cationic photoinitiators can include a salt having an onium cation and a halogen-containing complex anion of a metal or metalloid. Other cationic photoinitiators include a salt having an organometallic complex cation and a halogen-containing complex anion of a metal or metalloid. These photoinitiators are further described in U.S. Pat. No. 4,751,138 (col. 6, line 65 through col. 9, line 45). Another example is an organometallic salt and an onium salt described in U.S. Pat. No. 4,985,340 (col. 4, line 65 through col. 14, line 50); European Patent Applications 306,161; 306,162. Still other cationic photoinitiators include an ionic salt of an organometallic complex in which the metal is selected from the elements of Periodic Groups IVB, VB, VIB, VIIB, and VIIIB. This photoinitiator is described in European Patent Application 109,581.

The binder precursor may also be a condensation curable binder such as a phenolic resin, urea-formaldehyde resin, melamine-formaldehyde resin and the like. There are two types of phenolic resins, resole and novolac. Resole phenolic resins have a molar ratio of formaldehyde to phenol, of greater than or equal to one to one, typically between 1.5:1.0 to 3.0:1.0. Novolac resins have a molar ratio of formaldehyde to phenol, of less than to one to one. Examples of commercially available phenolic resins include those known by the tradenames "Durez" and "Varcum" from Occidental Chemicals Corp.; "Resinox" from Monsanto; "Arofene" from Ashland Chemical Co. and "Arotap" from Ashland Chemical Co. Additional details on urea-formaldehyde resins can be found in U.S. Pat. No. 5,486,219.

It is also within the scope of this invention to use a binder precursor that contains a blend of a condensation curable resin a free radical curable resin. For example, a resole phenolic resin and an acrylate resin can be blended together to form the binder precursor. One preferred binder precursor comprises an acrylate monomer such as trimethylol propane triacrylate, an acrylated isocyanurate resin such as triacrylate of tris(hydroxyethyl) isocyanurate, trimethylol propane triacrylate or pentaerythritol triacrylate and a resole phenolic resin. To help initiate the polymerization of the acrylate based resins, the binder precursor is exposed to heat and/or a radiation energy source. To help initiate the polymerization of the resole phenolic resin, the binder precursor is typically exposed to heat. For example, the binder precursor may comprise between about 10 to 90 parts by weight phenolic resin, preferably between 20 to 60 parts by weight phenolic resin and between about 40 to 90 parts by weight free radical curable resin, preferably between 20 to 60 parts by weight free radical curable resin.

In one particularly useful embodiment, the binder precursor may contain abrasive grits. The cured binder precursor, i.e., the binder, functions to bond the abrasive grits together to form a precisely shaped abrasive particle. The abrasive grits typically have an average particle size ranging) from about 0.1 to 1500 micrometers, preferably from about 1 to about 1300 micrometers, more preferably from about 1 to about 500 micrometers, and most preferably from about 1 to about 150 micrometers. It is preferred that the abrasive grits have a Mohs' hardness of at least about 8, more preferably above 9. Examples of materials of such abrasive grits include fused aluminum oxide, ceramic aluminum oxide, white fused aluminum oxide, heat treated aluminum oxide, silica, silicon carbide, green silicon carbide, alumina zirconia, diamond, ceria, titanium diboride, boron carbide, cubic boron nitride, garnet, tripoli, and combinations thereof. The ceramic aluminum oxide is preferably made according to a sol gel process, such as described in U.S. Pat. Nos. 4,314,827; 4,744,802; 4,623,364; 4,770,671; 4,881,951; 5,011,508; and 5,213,591. The ceramic abrasive grit comprises alpha alumina and, optionally, a metal oxide modifier, such as magnesia, zirconia, zinc oxide, nickel oxide, hafnia, yttria, silica, iron oxide, titania, lanthanum oxide, ceria, neodymium oxide, and combinations thereof. The ceramic aluminum oxide may also optionally comprise a nucleating agent, such as alpha alumina, iron oxide, iron oxide precursor, titania, chromia, or combinations thereof. The ceramic aluminum oxide may also have a shape, such as that described in U.S. Pat. Nos. 5,201,916 and 5,090,968. The ceramic abrasive grits may also contain a surface coating.

The abrasive grit may also have a surface coating. A surface coating can improve the adhesion between the abrasive grit and the binder in the abrasive particle and/or can alter the abrading characteristics of the abrasive grit. Such surface coatings are described in U.S. Pat. Nos. 5,011,508; 1,910,444; 3,041,156; 5,009,675; 4,997,461; 5,213,591; and 5,042,991. An abrasive grit may also contain a coupling agent on its surface, such as a silane coupling agent.

The binder precursor can contain a single type of abrasive grit, two or more types of different abrasive grits, or at least one type of abrasive grit with at least one type of diluent material. Examples of materials for diluents include calcium carbonate, glass bubbles, glass beads, greystone, marble, gypsum, polyvinyl chloride, clay, $SiO_2$, $KBF_4$, $Na_2SiF_6$, cryolite, organic bubbles, organic beads, and the like.

The binder precursor for use in this invention can further comprise optional additives, such as, for example, fillers (including grinding aids), fibers, lubricants, wetting agents, surfactants, pigments, dyes, coupling agents, plasticizers, antistatic agents, and suspending agents. Examples of fillers suitable for this invention include wood pulp, vermiculite, and combinations thereof, metal carbonates, such as calcium carbonate, e.g., chalk, calcite, marl, travertine, marble, and limestone, calcium magnesium carbonate, sodium carbonate, magnesium carbonate; silica, such as amorphous silica, quartz, glass beads, glass bubbles, and glass fibers; silicates, such as talc, clays (montmorillonite), feldspar, mica, calcium silicate, calcium metasilicate, sodium aluminosilicate, sodium silicate; metal sulfates, such as calcium sulfate, barium sulfate, sodium sulfate, aluminum sodium sulfate, aluminum sulfate; gypsum; vermiculite; wood flour; aluminum trihydrate, metal oxides, such as calcium oxide (lime), aluminum oxide, titanium dioxide, and metal sulfites, such as calcium sulfite. For example, the precisely shaped particle may comprise by weight between about 20 to 100 parts binder, preferably 40 to 100 parts binder and 0 to 80 parts filler, preferably 0 to 60 parts filler. In another embodiment, the precisely shaped particle comprises by weight 20 to 90 parts binder, preferably 25 to 80 parts binder, more preferably 30 to 70 parts binder; 10 to 80 parts abrasive grits, preferably 20 to 75 parts abrasive grit, more preferably 30 to 70 parts abrasive grit, 1 to 60 parts filler, 5 to 50 parts filler and 10 to 40 parts filler.

A grinding aid is defined as particulate material the addition of which to an abrasive article has a significant effect on the chemical and physical processes of abrading, thereby resulting in improved performance. In particular, it is believed that the grinding aid will (1) decrease the friction between the abrasive grits and the workpiece being abraded, (2) prevent the abrasive grits from "capping", i.e., prevent metal particles from becoming welded to the tops of the abrasive grits, (3) decrease the interface temperature between the abrasive grits and the workpiece and/or (4) decrease the grinding forces. In general, the addition of a grinding aid increases the useful life of the coated abrasive article. Grinding aids encompass a wide variety of different materials and can be inorganic or organic. Examples of grinding aids include waxes, organic halide compounds, halide salts, and metals and their alloys. The organic halide compounds will typically break down during abrading and release a halogen acid or a gaseous halide compound. Examples of such materials include chlorinated waxes, such as tetrachloronaphthalene, pentachloronaphthalene, and polyvinyl chloride. Examples of halide salts include sodium chloride, potassium cryolite, sodium cryolite, ammonium cryolite, potassium tetrafluoroborate, sodium tetrafluoroborate, silicon fluorides, potassium chloride, and magnesium chloride. Examples of metals include tin, lead, bismuth, cobalt, antimony, cadmium, iron, and titanium. Other grinding aids include sulfur, organic sulfur compounds, graphite, and metallic sulfides. It is also within the scope of this invention to use a combination of different grinding aids and, in some instances, this may produce a synergistic effect. The above-mentioned examples of grinding aids is meant to be a representative showing of grinding aids, and it is not meant to encompass all grinding aids. Additional examples of grinding aids include sodium metaphosphate, tripotassium phosphate and blends of polyvinyl chloride and potassium tetrafluoroborate The precisely shaped grinding aid particle may comprise by weight between about 5 to 95 parts binder, preferably 25 to 70 parts binder and 5 to 95 parts grinding aid, preferably 30 to 75 parts grinding aid.

It is also within the scope of this invention to employ an acrylated binder that contains a chlorine group. Examples of such binders include "Ebecryl 436", "584", "585", "586" and "588", all commercially available from Radcure Specialties, Inc. (Louisville, Ky.). Although not wishing to be bound by any theory, these chlorinated acrylate monomers may function both as a binder and a grinding aid. Under the appropriate abrading conditions the chlorine may be released during abrading.

Examples of coupling agents suitable for this invention include organo-silanes, zircoaluminates, and titanates. A suitable coupling agent may be selected for the abrasive grit and/or the filler. The coupling agent may be applied directly into the mixture of binder plus abrasive grit and/or filler. Alternatively, the abrasive grit and/or filler may be pretreated with the coupling agent. Examples of antistatic agents include graphite, carbon black, conductive polymers, humectants, vanadium oxide, and the like. The amounts of these materials can be adjusted to provide the properties desired. The binder precursor can optionally include water or an organic solvent.

The precisely shaped particles may further comprise a plasticizer. Examples of plasticizers include polyvinyl chloride, dibutyl phthalate, alkyl benzyl phthalate, polyvinyl acetate, polyvinyl alcohol, cellulose esters, phthalate esters, silicone oils, adipate and sebacate esters, polyols, polyols derivatives, t-butylphenyl diphenyl phosphate, tricresyl phosphate, castor oil, combinations thereof and the like. The amount of plasticizer can range from about 0 to about 70%, preferably from about 0% to about 65% by weight based on the total weight of the binder, not including the optional additives and abrasive particles.

Examples of lubricants include waxes, metal salts of fatty acids, sulfur based compounds, graphite, molybdenum disulfide, talc, boron nitride, silicones, silicone oils, polyglycols, phosphate esters, silicate esters, neopentyl polyol esters and polyphenyl ethers, fluorochemicals, mineral oils, combinations thereof and the like.

The amount of these additives in the precisely shaped particle will depend in part upon the desired properties. Examples of preferred additives include fillers, grinding aids, coupling agents and wetting agents. For example, for a diluent particle, the precisely shaped particle may comprise binder and filler particles. Likewise for example, a diluent particle for an abrasive article may comprise binder and grinding aid. Alternatively an abrasive precisely shaped particle may comprise binder, abrasive grits, optionally filler, optionally grinding aid and optionally coupling agent.

The precisely shaped particle may further contain a loading resistant additive. "Loading" is a term used to describe the filling of spaces between abrasive grits with swarf (the material abraded from the workpiece) and the subsequent build-up of that material. For example, during wood sanding, swarf comprised of wood particles becomes lodged in the spaces between abrasive grits, dramatically reducing the cutting ability of the abrasive grits. Examples of such loading resistant materials include metal salts of fatty acids, urea-formaldehyde, waxes, mineral oils, crosslinked silanes, crosslinked silicones, phosphate esters, fluorochemicals and combinations thereof. In one aspect of this invention, one or more of these loading resistant materials can be incorporated into the precisely shaped particle. These resulting precisely shaped particles may be incorporated into an abrasive article, along with either abrasive agglomerates or abrasive grits. For example, a coated abrasive may comprise a backing having a front and back side. A make coat is present on the front surface of the backing and this make coat serves to bond an abrasive layer to the front surface of the backing. The abrasive layer comprises abrasive grits and precisely shaped particles containing a loading resistant material. Over the abrasive layer is a size coat.

The binder precursor may optionally further comprise an expanding agent. The expanding agent will typically increase the porosity of the precisely shaped particle. The expanding agent can be any chemical or material that the presence of which increases the volume of the precisely shaped particle. The expanding agent can be steam or an organic solvent capable of swelling the particle.

The binder precursor may further comprise a surfactant. Examples of surfactants include metal alkoxides, fluorochemicals, polyalkylene oxides, salts of long chain fatty acids and the like. The surfactants may be cationic, anionic or non-ionic. Examples of preferred surfactants include an anionic dispersing agent commercially available from Byk Chemie, Wallingford, Conn. under the trade designation "Disperbyk 111" and a polyethylene oxide based dispersant commercially available from ICI Chemicals, of Wilmington, Del. under the trade designation "Hypermer KD2".

If the particle contains abrasive grits, it is preferred that the particle be capable of breaking down during abrading. The selection and amount of the binder precursor, abrasive grits, and optional additives will influence the breakdown characteristics of the particle. Additionally, the amount of porosity in the precisely shaped particle will influence the break down and wear characteristics of the precisely shaped particle. The level or degree of porosity can be determined by the binder chemistry, the additives (including abrasive grits), processing conditions and combinations thereof. Thus, the amount of porosity should be tailored to the desired break down or wear characteristics for a given use of the precisely shaped particle.

In order to form a mixture comprising a binder precursor and other materials, such as abrasive grits, the components can be mixed together by any conventional technique, such as, for example high shear mixing, air stirring, or tumbling. A vacuum can be used on the mixture during mixing to minimize entrapment of air. Alternatively in some instances it is preferred to entrap air or other gaseous materials into the abrasive slurry during mixing. This entrapped air tends to lead to a more porous precisely shaped particles.

The binder precursor can be introduced to the cavity of the production tool by a dispensing means that utilizes any conventional technique, such as, for example, gravity feeding, pumping, die coating, or vacuum drop die coating. The binder precursor can also be introduced to the cavities of the production tool by transfer via a first carrier web. Examples of carrier webs include cloth backings (including untreated cloth backings, greige cloth backings, treated cloth backings and the like), nonwoven substrates (including paper), polymeric film (including primed film, unprimed film, fibrous reinforced film and the like), vulcanized fiber, and any other suitable substrate type backing. The binder precursor can be subjected to ultrasonic energy during the mixing step or immediately prior to the coating step in order to lower the viscosity of the binder precursor Although the binder precursor is only required to fill a portion of the cavity, the binder precursor preferably completely fills the cavity in the surface of the production tool, so that the resulting particulate material will contain few voids or imperfections. These imperfections cause the shape of the particulate material to depart from the desired precise shape. Additionally, when the precisely shaped binder material is removed from the production tool, an edge may break off, thereby creating an imperfection and detracting from the preciseness of the shape. It is preferred that care be taken throughout the process to minimize such imperfections. Sometimes, voids or imperfections are desirable, because they create porosity in the resultant particles, thereby causing the particles to have greater erodibility. It is also preferred that the binder precursor not extend substantially beyond the plane of the continuous surface of the production tool and not extend substantially beyond the openings of the cavities of the production tool It is sometimes preferred that the binder precursor be heated prior to being introduced to the production tool, typically at a temperature in the range of from about 40 to 90° C. When the binder precursor is heated, its viscosity is reduced with the result that it can flow more readily into the cavities of the production tool.

The step following the introduction of the binder precursor into the cavities of the production tool involves at least partially curing the binder precursor by exposing it to radiation energy or thermal energy while it is present in the cavities of the production tool. Alternatively, the binder precursor can be at least partially cured while it is present in the cavities of the production tool, and then post-cured after the binder is removed from the cavities of the production tool. The post-cure step can be omitted. The degree of cure is sufficient that the resulting solidified, handleable binder will retain its shape upon removal from the production tool.

Examples of sources of radiation energy for use in the curing zone include electron beam, ultraviolet light, visible light, and laser light. Electron beam radiation, which is also known as ionizing radiation, can be used at an energy level of about 0.1 to about 20 Mrad, preferably at an energy level of about 1 to about 10 Mrad. Ultraviolet radiation refers to non-particulate radiation having a wavelength within the range of about 200 to about 400 nanometers, preferably within the range of about 250 to 400 nanometers. The dosage of radiation can range from about 50 to about 1000 mJ/cm$^2$, preferably from about 100 mJ/cm$^2$ to about 400 mJ/cm$^2$. Examples of lamp sources that are suitable for providing this amount of dosage provide about 100 to about 600 watts/inch, preferably from about 300 to about 600 watts/inch. Visible radiation refers to non-particulate radiation having a wavelength within the range of about 400 to about 800 nanometers, preferably in the range of about 400 to about 550 nanometers. The amount of radiation energy needed to sufficiently cure the binder precursor depends upon factors such as the depth of the binder precursor while in the cavity, the chemical identity of the binder precursor, and the type of loading material, if any. Conditions for thermal cure range from a temperature of about 50 to about 200° C. and for a time of from fractions to thousands of minutes. The actual amount of heat required is greatly dependent on the chemistry of the binder precursor.

After being at least partially cured, the resulting solidified, handleable binder will preferably not strongly adhere to the surface of the production tool. In either case, at this point, the solidified binder precursor is removed from the production tool.

There are several alternative methods for removing the solidified, handleable binder i.e., the binder, from the production tool. In one method, the binder is transferred directly from the production tool to a collector, e.g., a hopper. In this method, if the production tool is made of a polymeric material, the binder can be removed from the cavities by ultrasonic energy, a vacuum, an air knife, or combinations thereof or other conventional mechanical means. If the production tool is made of metal, the binder can be removed from the cavities by means of a water jet or air jet. If the production tool has cavities that extend completely through the production tool, e.g., if the production tool is a belt having perforations extending completely therethrough, the binder can be removed by ultrasonic energy, mechanical force, water jet, air jet, or combinations thereof, or other mechanical means, regardless of the material of construction of the production tool.

In another method, the binder can be transferred indirectly from the production tool to a collector. In one embodiment, the binder can be transferred from the production tool to a smooth roll. The binder exhibits greater adhesion to the smooth roll than to the production tool. The transferred binder can then be removed from the smooth roll by means of skiving, vacuum, water jet, air jet, or other mechanical means. In one particular embodiment, the binder can be transferred from the production tool to a major surface of a second carrier web. The binder exhibits greater adhesion to the major surface of the carrier web than to the production tool. Examples of carrier webs include cloth backings (including untreated cloth backings, greige cloth backings, treated cloth backings and the like), nonwoven substrates (including paper), polymeric film (including primed film, unprimed film, fibrous reinforced film and the like), vulcanized fiber, and any other suitable substrate type backing. Some preferred examples of carrier webs include corona treated polyester film and cloth substrates containing a polyamide presize coating. It is also within the scope of this invention to corona treat the carrier web prior to the precisely shaped particles being transferred to the carrier web. Additionally, the first and second carrier webs may be made from the same material or a different material.

The major surface of the carrier web to which the binder is transferred can bear a layer of material that is soluble in water or an organic solvent. The binder can easily be removed from the carrier web by merely dissolving the material that forms the soluble layer. In addition, mechanical means, e.g., skiving, vacuum, or ultrasound, can be used to remove the binder. Ultrasonic energy can be applied directly over a major surface of the web or off to a side of a major surface of the web. In another embodiment, the major surface of the carrier web can have a primer thereon. Examples of primers suitable for the carrier web include ethylene acrylic acid copolymer, polyvinylidene chloride, crosslinked hexanediol diacrylate, aziridine materials, and the like. The binder will preferentially adhere to the primed carrier web. The binder can then be removed from the primed carrier web by mechanical means, e.g., skiving, vacuum, or ultrasound.

After the binder is removed from the production tool, either by direct or indirect means, it is then converted into particles. In one mode of conversion, the binder is released from the production tool in the form of particles. A given particle will have a shape that is essentially the shape of the portion of the cavity of the production tool in which the particle was at least partially cured. An advantage of this mode is that the particles are already of the proper grade or of the proper particle size distribution for subsequent use, e.g., incorporation into an abrasive article. In the conventional manner of making abrasive particles, e.g., agglomerates, the abrasive particles have to be crushed and then screened to obtain proper particle size distribution.

In a second mode of conversion, the binder is released from the production tool as a sheet of material comprising precisely shaped binder material interconnected by a thin layer of binder material. The binder is then broken or crushed along the thin interconnecting portions to form the particles of this invention.

The process of the invention lends itself to an economical means to make abrasive particles comprising a plurality of abrasive grits distributed in a binder. In the preferred aspect of the invention, the process results in precisely shaped abrasive particles. However, it is within the scope of this invention to have an additional steps in which these precisely shaped abrasive particles are crushed or broken into randomly shaped abrasive particles.

In a variation, the production tool can be a drum or a belt that rotates about an axis. When the production tool rotates about an axis, the process can be conducted continuously. When the production tool is stationary, as in processes of the prior art, the process is conducted batch-wise. The continuous process of this invention is usually more efficient and economical than the batch-wise processes of the prior art.

This invention also provides abrasive articles containing abrasive particles made according to the process of this invention. These abrasive articles can be bonded abrasive articles, coated abrasive articles, or nonwoven abrasive articles. For a bonded abrasive article, the precisely shaped abrasive particles are bonded together by a bonding medium to form a shaped mass, e.g., a wheel, a cut-off wheel. Bonded abrasive articles are typically made by a molding process. For a coated abrasive article, the abrasive precisely shaped particles are bonded by a bonding medium to a backing. For a nonwoven abrasive article, the abrasive precisely shaped particles are bonded by a bonding medium into a nonwoven fibrous substrate.

Backings suitable for preparing coated abrasive articles include polymeric film, primed polymeric film, cloth, paper, vulcanized fibre, polymeric foam, nonwovens, treated versions thereof, and combinations thereof. Examples of polymeric film include polyester film, polyolefin films (polyethylene and propylene film), polyamide films, polyimide films and the like. Another example of a backing is a fibrous reinforced thermoplastic such as that described in described in U.S. Pat. No. 5,417,726. One popular coated abrasive backing is a cloth backing. The cloth is composed of yarns in the warp direction, i.e., the machine direction and yarns in the fill direction, i.e., the cross direction. The cloth backing can be a woven backing, a stitchbonded backing, or a weft insertion backing. Examples of woven constructions include sateen weaves of 4 over one weave of the warp yarns over the fill yarns; twill weave of 3 over one weave; plain weave of one over one weave and a drill weave of two over two weave. In a stitchbonded fabric or weft insertion backing, the warp and fill yarns are not interwoven, but are oriented in two distinct directions from one another. The warp yarns are laid on top of the fill yarns and secured to another by a stitch yarn or by an adhesive. The yarns in the cloth backing can be natural, synthetic or combinations thereof. Examples of natural yarns include cellulosic such as cotton, hemp, kapok, flax, sisal, jute, carbon, manila and combinations thereof Examples of synthetic yarns include polyester yarns, polypropylene yarns, glass yarns, polyvinyl alcohol yarns, polyimide yarns, aromatic polyamide yarns, rayon yarns, nylon yarns, polyethylene yarns and combinations thereof. The preferred yarns of this invention are polyester yarns, nylon yarns, a mixture of polyester and cotton, rayon yarns and aromatic polyamide yarns. The cloth backing can be dyed and stretch, desized or heat stretched. Additionally the yarns in the cloth backing can contain primers, dyes, pigments or wetting agents. The yarns can be twisted or texturized. The coated abrasive backing may have an optional saturant coat, presize coat and/or backsize coat. These coats may seal the backing and/or protect the yarns or fibers in the backing. The addition of the presize coat or backsize coat may additionally result in a "smoother" surface on either the front or back side of the backing. The backsize coat may contain an antistatic material or a lubricant material.

Figure 4:
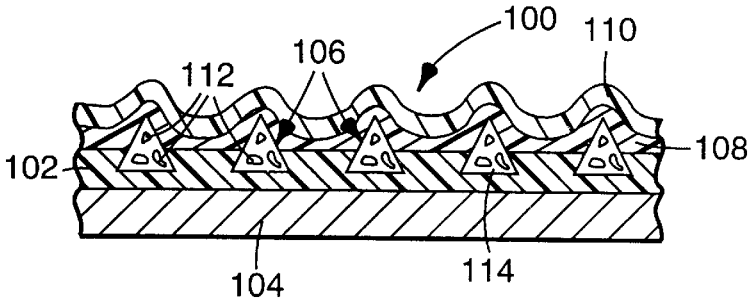
FIGS. 4 and 5 are schematic side views in elevation of a coated abrasive article that utilizes the particles of this invention.
Figure 5:
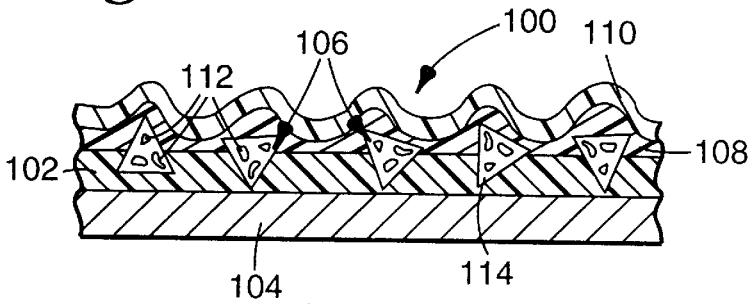

Referring to FIGS. 4 and 5, coated abrasive article 100 contains two coatings for binding the abrasive particles to the backing. Coating 102, commonly referred to as a make coat, is applied over backing 104 and bonds abrasive particles 106 to backing 104. Coating 108, commonly referred to as a size coat, is applied over abrasive particles 106 and reinforces abrasive particles 106. There may also be a third coating 110, commonly referred to as a supersize coat, applied over the size coat 108. As mentioned previously, the abrasive particles 106 comprise a plurality of abrasive grits 112 and a binder 114. The abrasive particles can be applied to the backing by conventional techniques, e.g., by drop coating or by electrostatic coating. Depending upon the coating method, the abrasive particles can either be oriented in a non-random manner as in FIG. 4 or oriented in a random manner as in FIG. 5.

The material for bonding the abrasive material to a substrate or together comprises a cured resinous adhesive and optional additives. Examples of resinous adhesives suitable for this invention include phenolic resins, aminoplast resins, urethane resins, epoxy resins, acrylate resins, acrylated isocyanurate resins, urea-formaldehyde resins, isocyanurate resins, acrylated urethane resins, vinyl ethers, acrylated epoxy resins, and combinations thereof. The optional additives include fillers (including grinding aids), fibers, lubricants, wetting agents, surfactants, pigments, dyes, coupling agents, plasticizers, and suspending agents. Examples of fillers include talc, calcium carbonate, calcium metasilicate, silica and combinations thereof. The amounts of these materials are selected to provide the properties desired.

Examples of fillers that can be incorporated into either a coated abrasive article, a structured abrasive article, a nonwoven abrasive article or a bonded abrasive article include wood pulp, vermiculite, and combinations thereof, metal carbonates, such as calcium carbonate, e.g., chalk, calcite, marl, travertine, marble, and limestone, calcium magnesium carbonate, sodium carbonate, magnesium carbonate; silica, such as amorphous silica, quartz, glass beads, glass bubbles, and glass fibers; silicates, such as talc, clays (montmorillonite), feldspar, mica, calcium silicate, calcium metasilicate, sodium aluminosilicate, sodium silicate; metal sulfates, such as calcium sulfate, barium sulfate, sodium sulfate, aluminum sodium sulfate, aluminum sulfate; gypsum; vermiculite; wood flour; aluminum trihydrate; metal oxides, such as calcium oxide (lime), aluminum oxide, titanium dioxide, and metal sulfites, such as calcium sulfite. For example, the abrasive article bonding medium may comprise by weight between about 0 to 80 parts filler, preferably 0 to 70 parts filler and more preferably about 0 to 55 parts filler.

Examples of grinding aid that can be incorporated into either a coated abrasive article, a nonwoven abrasive article or a bonded abrasive article include waxes, organic halide compounds, halide salts, and metals and their alloys. The organic halide compounds will typically break down during abrading and release a halogen acid or a gaseous halide compound. Examples of such materials include chlorinated waxes, such as tetrachloronaphthalene, pentachloronaphthalene, and polyvinyl chloride. Examples of halide salts include sodium chloride, potassium cryolite, sodium cryolite, ammonium cryolite, potassium tetrafluoroborate, sodium tetrafluoroborate, silicon fluorides, potassium chloride, and magnesium chloride. Examples of metals include tin, lead, bismuth, cobalt, antimony, cadmium, iron, and titanium. Other grinding aids include sulfur, organic sulfur compounds, graphite, and metallic sulfides. Still other examples of grinding aid include sodium metaphosphate, tripotassium phosphate and blends of polyvinyl chloride and potassium tetrafluoroborate. It is also within the scope of this invention to use a combination of different grinding aids and, in some instances, this may produce a synergistic effect. For example, the abrasive article bonding medium may comprise by weight between about 0 to 80 parts grinding aid, preferably 0 to 70 parts grinding aid and more preferably about 10 to 55 parts grinding aid.

Examples of coupling agents that can be incorporated into the bonding medium for a coated abrasive, nonwoven abrasive or bonded abrasive include organo-silanes, zircoaluminates, and titanates. A suitable coupling agent may be selected for the abrasive grit and/or the filler. The coupling agent may be applied directly into the mixture of bonding medium plus abrasive grit and/or filler. Alternatively, the abrasive grit and/or filler may be pretreated with the coupling agent.

It is also within the scope of this invention to incorporate a precisely shaped filler particle and/or a precisely shaped grinding aid particle into the bonding medium for the abrasive article. In general, the particle size of these precisely shaped filler particles and/or precisely shaped grinding particles should be controlled so that the bonding medium can be appropriately processed when the abrasive article is manufactured. For example in a coated abrasive or nonwoven abrasive, the particle size of the precisely shaped filler particles and/or precisely shaped grinding aid particles should be less than about 100 micrometers, preferably less than about 50 micrometers such that the resulting make and/or size coat can be properly coated.

A nonwoven abrasive article comprises an open, porous, fibrous, nonwoven substrate having a plurality of abrasive particles bonded into the substrate. This type of nonwoven abrasive article is described in U.S. Pat. No. 2,958,593.

Bonded abrasives products typically comprise a plurality of abrasive grits bonded together by means of a bonding medium to form a shaped mass. The preferred bonding medium is typically a cured or crosslinked organic binder. The shaped mass is preferably in the form a grinding wheel. However, there are numerous forms of bonded abrasives such as honing stones, polishing sticks, saw blades, cutting sticks, mounted points, snagging wheels, dressing tools, cup wheels, honing stones, cut off wheels, depressed center wheels, flap wheels and the like. The grinding wheel can range in diameter from about 0.1 cm to 2 meters and typically between 1 cm to 2 meters. The grinding wheel thickness can range from about 0.001 cm to about 1 meter, typically between 0.01 cm to 0.5 meter. The bonded abrasive article may be dressed by any conventional technique during the life of the bonded abrasive article. Alternatively, the bonded article can be formulated such that the resulting construction does not need to be dressed.

The precisely shaped particles of the invention may be incorporated into a cut off wheel. A cut off wheel typically has a diameter between 1 cm to 500 cm and has thickness between 0.01 cm to 1 cm. The cut off wheel may also contain a reinforcing fabric. Examples of reinforcing substrates include textiles, meshes and the like. The yarns in the reinforcing substrates may be made from synthetic organic fibers such as nylon, polyester, rayon, cotton or the like. Alternatively the yarns in the reinforcing substrates may be made of inorganic fibers such as fiberglass, alumina, metal or the like.

The bonded abrasive article may utilize an organic bonding medium, a vitrified bonding medium or a metal bonding medium. The organic bonding mediums are described above, along with the additives that can be incorporated into the organic bonding medium. Other organic bonding mediums include rubber bonds and shellac bonds. Additionally, the bonded abrasive may contain a rubber based bonding medium. One common bonding medium is a novolac phenolic bonding medium that is crosslinked with hexamethylenetetramine. Examples of commercially available phenolic bonding mediums include Varcum 8121 (liquid resole) and Varcum 7909 (powdered novolac) from Varcum Chemical Company, Niagara Falls, N.Y. If the bonded abrasive is made via a molding process, it is preferred to use a combination of powdered organic bonding mediums and liquid organic bonding mediums. During molding, the liquid organic bonding medium is first mixed with the abrasive grits and/or precisely shaped particles. This results in the liquid wetting the surface of the abrasive grits and/or precisely shaped particles. Next, the dry or powdered bonding mediums are mixed with the liquid bonding medium/abrasive grits. In some instances, it may be preferred to include reinforcing fibers in the bonding medium. The addition of these reinforcing fibers may improve the bonded wheel strength, wear properties or heat resistance properties. Examples of such reinforcing fibers include glass fibers, metal fibers, organic fibers (e.g., aramid fibers, polyolefin fibers, polyamide fibers, polyester fibers and the like), inorganic fibers (e.g., alumina fibers, silicate fibers and the like).

The bonded abrasive article typically contains some form of porosity. The amount of the porosity strongly influences this break down characteristic. In general, many bonded abrasives are designed for the desired abrading application. The bonded abrasive can have any range of porosity, for example the porosity in some instances ranges from about 1% to 50%, typically 1% to 40% by volume. There are several means to incorporate porosity into a bonded abrasive article. One such means is the use of porous bodies, diluents or other soft particles. Some examples of porous bodies include hollow spheres of glass, alumina, metal or polymers. In some instances, the addition of certain fillers will increase the porosity and/or break down characteristics of the bonded abrasive. Another means is to incorporate an expanding agent in the bonded abrasive and typical expanding agents are described above. Still another such means is to use fugitive materials that during the heating of either the organic or vitreous bonding medium will decompose, thereby leaving porosity. These fugitives materials are typically utilized more in vitrified wheels than in resin bonded wheels. Examples of such fugitive materials include walnut shells, sugar, diphthalic hydrocarbon, thermoplastic particles and the like.

The bonded abrasive article of the invention may be made by compression molding, injection molding or transfer molding or the like. The molding can be either by hot or cold pressing or any suitable manner well known to those skilled in the art. After the bonded abrasive article is molded, it is typically heated to help initiate the polymerization or curing of the bonding medium. The bonded abrasive may be made in such a manner that the abrasive grain of the invention is only present in the outer portion or rim of the wheel.

The depressed center wheels usually grind on the flat face. In the center of the wheels is a mounting means to connect this wheel to a tool. The mounting means may be a center hole forming an arbor hole. In many instances these depressed center wheels contain a flat center or a depressed center. The depressed center wheels may be molded to the shape of a shallow dish or saucer with curved or straight flaring sides. The back side (i.e., the side opposite of the abrasive coating) of the depressed center wheels may contain a reinforcing fabric, a reinforcing paper backing or some other support means such as a metal or plastic plate.

During use, the bonded abrasive article can be used dry or wet. During wet grinding, the bonded abrasive is used in conjunction with water, oil based lubricants or water based lubricants The abrasive articles of this invention may further contain conventional abrasive agglomerates or individual abrasive grits or both. Conventional abrasive agglomerates are further described in U.S. Pat. Nos. 4,311,489; 4,652,275; and 4,799,939. Individual abrasive grits can also be selected to have a precise shape. Examples of individual abrasive grits include fused aluminum oxide, ceramic aluminum oxide, heat treated aluminum oxide, silicon carbide, alumina zirconia, diamond, ceria, cubic boron nitride, garnet, and combinations thereof. At least 10%, preferably at least 50%, and most preferably at least 70%, of the abrasive material should be the precisely shaped abrasive particles of this invention. In a coated abrasive article, the individual abrasive grits can be disposed over the precisely shaped abrasive particles. Alternatively, the individual abrasive grits can be disposed underneath the precisely shaped abrasive particles. The individual abrasive grit can be disposed between two precisely shaped abrasive particles.

It is preferred that the precisely shaped particles have no dimension greater than 2500 micrometers. It is preferred that the size of the precisely shaped particles range from 0.1 to 1500 micrometers, more preferably from 0.1 to 500 micrometers and even more preferably 50 to 500 micrometers. As indicated previously, the precise shape corresponds to portions of the surface of the production tool, e.g., cavities formed in the surface of the production tool. The particles of this invention have a precise shape. This precise shape is attributable to the binder precursor's being at least partially cured in the cavities of the production tool. There may, however, be minor imperfections in the particles that are introduced when the particles are removed from the cavities. If the binder precursor is not sufficiently cured in the cavities, the binder precursor will flow, and the resulting shape will not correspond to the shape of the cavities. This lack of correspondence gives an imprecise and irregular shape to the particle. This precise shape can be any geometrical shape, such as a cone, triangular prism, cylinder, pyramid, sphere, and a body having two opposed polygonal faces separated by a constant or varying distance, i.e., a polygonal platelet. Pyramids preferably have bases having three or four sides. The abrasive article may contain a variety of abrasive particles having different shapes. FIG. 7 is a scanning electron photomicrograph taken at about 300 magnification of an abrasive particle in the form of a pyramid having a triangular base.

The weight percentages of the grinding aid particulate and the binder in the precisely shaped grinding aid particle will depend on several factors, such as the intended use of the abrasive article and the particle size and distribution of the abrasive grit used in the abrasive article. Typically, the percent by weight grinding aid particulate will range from about 5 to 95 percent and the percent by weight binder will range from about 95 to 5 percent. Preferably, the percentage, based on weight, of grinding aid particulate ranges from 20 to 75 percent and the percentage of binder ranges from 80 to 25 percent.

In another aspect of this invention, the precisely shaped particles do not contain any abrasive grits. These precisely shaped particles that are free of abrasive grits can be used in a coated abrasive article as a diluent particle. For example, a coated abrasive article may comprise a backing, and bonded to the backing are abrasive grits and precisely shaped particles that are free of abrasive grits. Alternatively, the coated abrasive article may comprise a backing, a first coat of cured resinous adhesive (make coat) applied over the front surface of the backing, abrasive grits and precisely shaped particles, wherein the grits and precisely shaped particles are secured to the backing by means of the make coat. Over the abrasive grits and precisely shaped particles is a second coat of cured resinous adhesive (size coat).

The precisely shaped abrasive particles can be coated or placed randomly onto the backing. Alternatively, the precisely shaped abrasive particles can be oriented on the backing in a specified direction. In the case of precisely shaped particles having the shapes of pyramids, cones, and prisms (e.g., triangular-shaped prisms), the particles can be oriented so that their bases point toward the backing and their vertexes point away from the backing, as in FIG. 4, or they can be oriented so that their vertexes point toward the backing and their bases point away from the backing, as do four of the particles in FIG. 5. With respect to pyramids and cones, the vertex referred to is the common vertex.

In general, the coated abrasive article will comprise a backing having a front and back surface. Over the front surface of the backing, is a make coat and this make coat serves to bond an abrasive layer to the backing. Optionally, over the abrasive layer is a size coat. Optionally, over the size coat is a supersize coat. One preferred make coat is a crosslinked resole phenolic resin containing filler particles such as calcium carbonate. One preferred size coat is a crosslinked resole phenolic resin containing filler particles such as calcium carbonate. Another preferred size coat is a crosslinked resole phenolic resin containing grinding aid particles such as cryolite, chiolite or tetrafluoroborate particles. One preferred supersize coat is a crosslinked epoxy resin, optionally a thermoplastic polymer and grinding aid particles such as cryolite, chiolite or tetrafluoroborate particles. This type of supersize coat is further described in European Patent Application No. 486,308 and U.S. Pat. No. 5,441,549. The coated abrasive may optionally contain a supersize coating which prevents the coated abrasive from "loading". The various materials forming either the make coat, size coat and/or supersize coat will depend in part upon the final coated abrasive product requirements and the intended abrading application for the coated abrasive.

The precisely shaped particles of the invention may also be incorporated into a lapping coated abrasive article. This lapping coated abrasive article comprises a backing having a front and back surface and an abrasive coating bonded to the front surface of the backing. The abrasive coating comprises a plurality of precisely shaped abrasive particles distributed throughout a make coat.

The precisely shaped particles may also be incorporated into a structured abrasive article. In general, a structured abrasive article may comprise a plurality of precisely shaped abrasive composites bonded to a backing. These abrasive composites may include the precisely shaped particles, with or without abrasive grits in these particles. Relative to a structured abrasive article, it is preferred that the particle size of the precisely shaped particle be less than about 50 micrometers, preferably less than about 25 micrometers.

The coated abrasive may be converted into a variety of different shapes and forms such as belts, discs, sheets, tapes, daises and the like. The belts may contain a splice or a joint, alternatively the belts may be spliceless such as reported in International application WO 93/12911. Additionally, the coated abrasive may be secured to a support pad either through a pressure sensitive adhesive or a hook and loop attachment system.

In general, the nonwoven abrasive article comprises an open, lofty, porous nonwoven substrate. The nonwoven substrate comprises fibers and these fibers may be polyamide fibers (e.g., nylon fibers), polyester fibers, Polyolefin fibers, combinations thereof and the like. The fibers in the nonwoven substrate may be generally bonded together at their points of mutual contact with a prebond coating or prebond bonding medium. An abrasive layer is bonded to this open, porous nonwoven substrate. The abrasive layer may consist of a mixture of abrasive grits and make coat. This abrasive layer is formed by coating (e.g., roll coating or spray coating) a mixture of the make coat precursor and abrasive grits or precisely shaped abrasive particles. Alternatively, the nonwoven abrasive article may comprise a make coat present in and over the nonwoven substrate, an abrasive layer bonded in and to the nonwoven substrate by means of the make coat. In this nonwoven abrasive article construction, the make coat and abrasive layer are applied in different steps. Additionally, an optional size coat may be present over the abrasive layer for both types of nonwoven abrasive articles. The nonwoven abrasive article may be converted into a wide variety of forms including sheets, discs, rolls, hand pads, endless belts, wheels and the like.

In general, a bonded abrasive article comprises a plurality of abrasive grits bonded together by a bonding medium (e.g., cured resinous adhesive) to form a shaped mass. At least a portion of the outer surface of the bonded abrasive is designed to contact a workpiece. This outer surface that contacts the workpiece comprises the bonding medium and an abrasive layer. The abrasive layer will comprise the precisely shaped particles of the invention and optionally other particles. These different abrasive layer configurations will be described below.

There are many different coated abrasive articles, nonwoven abrasive articles, structured abrasive articles and bonded abrasive articles that can be fabricated using the precisely shaped particles of this invention. For example, the abrasive layer may comprise solely just the precisely shaped abrasive particles in which these particles consist essentially of abrasive grits and binder. Alternatively, the precisely shaped abrasive particles may comprise abrasive grits, grinding aids, optionally other additives and binder.

In another example, the abrasive layer may comprise a mixture of individual abrasive grits and precisely shaped abrasive particles. The individual abrasive grits and the abrasive grits in the precisely shaped abrasive particles may be the same or they may be different. The individual abrasive grits may be randomly shaped or have a shape associated with them, such as a rod or triangular shape. These shaped individual abrasive grits are further described in U.S. Pat. Nos. 5,009,676; 5,035,723; 5,090,968; 5,103,598; 5,201,916 and 5,366,523. Likewise the particle size of the individual abrasive grits and the abrasive grits in the precisely shaped abrasive particles may be the same or they may be different. Analogously, the particle size of the individual abrasive grits and the particle size of the precisely shaped abrasive particle may be the same or they may be different.

In still another example, the abrasive layer may comprise a mixture of individual abrasive grits and precisely shaped grinding aid particles. These precisely shaped grinding aid particles consist essentially of grinding aid and binder. Similarly, the abrasive layer may comprise a mixture of precisely shaped abrasive particles and precisely shaped grinding aid particles. The particle size of the individual precisely shaped abrasive particles and the particle size of the precisely shaped grinding aid particles may be the same or they may be different. The surface area percentage of the precisely shaped grinding aid particles in the abrasive layer may range from about 5 to 90, preferably 20 to 40. Additionally the method of making the abrasive article may result in the individual abrasive grits either over, under and/or between the precisely shaped grinding aid particles.

The precisely shaped grinding aid particles have the potential to be very advantageous in abrasive articles. In some instances the bonding medium may not be compatible with a grinding aid For example, sometimes resole phenolic resins are used as a precursor for the bonding medium and this resole phenolic resin is cured or crosslinked with basic pH. In some instances, acidic grinding aids may be desired such as potassium tetrafluoroborate. In these situations, the potassium tetrafluoroborate may interfere with the polymerization of certain resole phenolic resins. This level of interference will depend in part upon the chemistry of the particular resole phenolic resin. A precisely shaped grinding aid particle will have the grinding aid essentially encapsulated within the binder. Thus, the grinding aid in this particle should have minimal interaction on the curing or polymerization of the bonding medium.

It is also within the scope of this invention to have abrasive articles comprising a plurality of abrasive grits and precisely shaped grinding aid particles in the abrasive layer and include a grinding aid in the bonding medium. The grinding aid in the bonding medium may be the same or different from the grinding aid in the precisely shaped grinding aid particle.

In yet another example, the abrasive layer may comprise a mixture of individual abrasive grits and precisely shaped loading resistant particles. These precisely shaped loading resistant particles comprise loading resistant materials and binder. The particle size of the individual precisely shaped abrasive particles and the particle size of the precisely shaped loading resistant particles may be the same or they may be different. The volume ratio between the individual abrasive grits and the precisely shaped loading resistant particles may range from about 0.1 to 10 parts individual abrasive grits to 0.1 to 10 parts precisely shaped loading resistant particles. Additionally the method of making the abrasive article may result in the individual abrasive grits either over, under and/or between the precisely shaped loading resistant particles.

Similarly, the abrasive layer may comprise a mixture of precisely shaped abrasive particles and precisely shaped filler particles. In a similar example, the abrasive layer may comprise a mixture of individual abrasive grits and precisely shaped filler particles. These precisely shaped filler particles comprise filler materials and binder. The volume ratio between the individual abrasive grits or the precisely shaped abrasive particles, and the precisely shaped filler particles may range from about 0.1 to 10 parts individual abrasive grits or precisely shaped abrasive particles to 0.1 to 10 parts precisely shaped filler particles. Additionally the method of making the abrasive article may result in the individual abrasive grits or precisely shaped abrasive particles either over, under and/or between the precisely shaped filler particles.

Additionally, the abrasive layer may comprise precisely shaped abrasive particles and diluent particles. These diluent particles can be selected from the group consisting of: 1) an inorganic particle (non abrasive inorganic particle), 2) an organic particle, 3) a composite diluent particle containing a mixture of inorganic particles and a binder and 4) a composite diluent particle containing a mixture of organic particles and a binder. The particle size of these diluent particles can range from about 0.01 to 1500 micrometers, typically between 1 to 1000 micrometers. The diluent particles may have the same particle size and particle size distribution as the precisely shaped abrasive particles. Alternatively, the diluent particles may have a different particle size and particle size distribution as the precisely shaped abrasive particles. The weight ratio of the precisely shaped abrasive particles to the diluent particle can range anywhere from about 1 to 99 parts precisely shaped abrasive particle of the invention to 1 to 99 parts diluent particle, typically between 10 to 90 parts precisely shaped abrasive particle of the invention to 10 to 90 parts diluent particle, preferably between 25 to 75 parts precisely shaped abrasive particle to 25 to 75 parts diluent particle, more preferably between 35 to 65 parts precisely shaped abrasive particle to 35 to 65 parts diluent particle, and most preferably between 50 to 50 parts precisely shaped abrasive particle to 50 to 50 parts diluent particle.

This representation of different configurations of the precisely shaped particles in the abrasive layer is not meant to be limiting, but rather exemplary of different uses of precisely shaped particles in an abrasive article.

Another aspect of this invention pertains to a novel coated abrasive article and a method of making a coated abrasive article. The coated abrasive article, comprises:

(a) a backing having a front and back surface;

(b) a make coat present on the front surface of the backing;

(c) an abrasive layer bonded to the front surface of the backing by means of the make coat, wherein the abrasive layer comprises a plurality of abrasive grits; and (d) a size coat present over the abrasive layer, wherein the size coat comprises:

(1) a solidified bonding medium and (2) a plurality of precisely shaped grinding aid particles, wherein the precisely shaped grinding aid particles comprise a binder and a plurality of grinding aid particulates.

The method of making a coated abrasive article, comprises the steps of:

(a) providing a backing having a front and back surface;

(b) applying a make coat precursor over the front surface of the backing;

(c) applying a plurality of abrasive grits into the make coat precursor;

(d) subjecting the backing, make coat precursor and abrasive grits to conditions to at least partially solidifying the make coat precursor and to form a solidified make coat;

(e) applying a size coat precursor over the abrasive grits;

(f) applying a plurality of precisely shaped grinding aid particles into the size coat precursor, wherein the precisely shaped grinding aid particles comprise a binder and a plurality of grinding aid particulates and (g) subjecting the backing, solidified make coat, abrasive grits and size coat precursor to conditions at least partially solidifying the size coat precursor to form a coated abrasive article.

The coated abrasive article can be made according to the following procedure. A backing having a front surface and a back surface is provided. The front surface of the backing is coated with a first curable bonding medium comprising a resinous adhesive (commonly referred to as a make coat); then the precisely shaped grinding aid particles and, optionally, the individual abrasive grits are coated or applied into the first curable bonding medium. The precisely shaped grinding aid particles and optional abrasive grits can be drop coated or electrostatic coated. The first curable bonding medium is then solidified or partially cured to form a cured resinous adhesive. Optionally, a second curable bonding medium (commonly referred to as a size coat) comprising a resinous adhesive can be applied over the precisely shaped particles and then solidified or cured to form a cured resinous adhesive. The second curable bonding medium can be applied prior to or subsequent to solidification or curing of the first curable bonding medium.

Alternately, individual abrasive grits can be first coated or applied into the first bonding medium and then the precisely shaped grinding aid particles coated on top.

It is within the scope of this invention to provide a coating on the outer surface of any of the precisely shaped particles. The coating can be continuous or discontinuous. Examples of coatings suitable for the particles include metal coatings, metal oxide coatings, carbide coatings, nitride coatings, boride coatings, carbon coatings, diamond coatings, diamond like carbon coatings, and the like. Alternatively an organic coating can be present on the surface of the particle. The organic coating may also contain fillers, coupling agents, antistatic agents, grinding aids, and the like.

The selection and amount of the coating will depend upon the desired properties of the particle. For instance, some coatings will result in a retro-reflective particle. Alternatively, some coatings will improve adhesion of the particle to other materials or a substrate.

It is also within the scope of this invention to use the precisely shaped particles as a loose abrasive slurry. These abrasive slurries typically comprise a mixture of precisely shaped particles and a liquid medium. The precisely shaped particles may further comprise abrasive grit(s), grinding aid(s), filler(s) or lubricant(s). It is also within the scope of this invention that the precisely shaped particle may comprise binder, abrasive grit and a grinding aid or lubricant. The abrasive grits, grinding aids and fillers are described above in detail. Examples of lubricants include waxes, metal salts of fatty acids, sulfur based compounds, graphite, molybdenum disulfide, talc, boron nitride, silicones, silicone oils, polyglycols, phosphate esters, silicate esters, neopentyl polyol esters and polyphenyl ethers, fluorochemicals, mineral oils, combinations thereof and the like. The liquid medium is generally water (including deionized water, tap water or distilled water) and sometimes organic solvent. Sometimes, the liquid is a mixture of water and other additives such as lubricants, rust inhibitors, coupling agents, anti-foams, anti-bacterial compounds, de-greasing compounds, oils, grinding aids, emusilified organic compounds, cutting fluids, soaps, waxes, combinations thereof and the like.

The loose abrasive slurry can be used in sandblasting type operations. Alternatively, the loose abrasive slurry can be used in combination with a lap plate or a polishing pad for lapping or polishing applications. The lap plate may be a rigid material such as a metal plate, ceramic plate or the like. The polishing pad may be a flexible material such as a foam pad (including polyurethane foam pads), a polymeric material (e.g., polyamide material, rubber material and the like) and the like. The polishing pad may also be a composite of a relatively rigid substrate (e.g., rigid plastic or metal) and a polyurethane foam bonded to the rigid substrate. The lap plate and/or polishing pad have a smooth outer surface or alternatively their outer surface may be textured, patterned or discontinuous.

In still another aspect of the invention pertains to a method of refining a workpiece outer surface. This method comprises the steps of:

(a) providing a plurality of precisely shaped abrasive particles, wherein the precisely shaped abrasive particles comprise a plurality of abrasive grits distributed in a binder, and wherein the binder is formed from a binder precursor comprising a free radically curable resin;

(b) providing at least one workpiece, wherein the workpiece has an outer surface;

(c) providing a vessel having a chamber capable of receiving at least one of said workpiece and said plurality of precisely shaped abrasive particles;

(d) causing said workpiece to traverse relative to a portion of said plurality of precisely shaped abrasive particles such that the precisely shaped abrasive particles refine the outer surface of the workpiece.

In yet another aspect of the invention pertains to a method of refining a workpiece outer surface This method comprises the steps of:

(a) providing a production tool having a three-dimensional body which has at least one continuous surface, said surface containing at least one opening formed in said continuous surface, said at least one opening providing access to a cavity in said three-dimensional body;

(b) providing a dispensing means capable of introducing a binder precursor comprising a thermosetting resin into said at least one cavity through said at least one opening;

(c) providing a means, within a curing zone, for at least partially curing said binder precursor;

(d) introducing said binder precursor into at least a portion of said at least one cavity;

(e) continuously moving said at least one cavity through said curing zone to at least partially cure said binder precursor to provide a solidified, handleable binder having a shape corresponding to that portion of the cavity into which the binder precursor had been introduced;

(f) removing said binder from said at least one cavity;

(g) converting said binder to form a plurality of precisely shaped particles;

(h) providing a plurality of said precisely shaped particles, wherein the precisely shaped particles comprise a binder;

(i) providing at least one workpiece, wherein the workpiece has an outer surface;

(j) providing a vessel having a chamber capable of receiving at least one of said workpiece and said plurality of precisely shaped particles;

(k) causing said workpiece to traverse relative to a portion of said plurality of precisely shaped particles such that the precisely shaped particles refine the outer surface of the workpiece.

It is preferred that these precisely shaped particles further comprise at least one of the following materials: abrasive grits, lubricants, fillers, grinding aids and combinations thereof.

The vessel may be any suitable container having a chamber therein. The chamber is a structure capable of receiving the workpiece and the plurality of precisely shaped particles and optionally a liquid medium. There should be sufficient room in the chamber for the precisely shaped particles to effectively refine the workpiece outer surface.

The precisely shaped particles, whether the particles are incorporated into an abrasive article or the particles are employed as a loose slurries, can be designed to refine a portion of the outer surface of a workpiece. The term refine means that the particles will do at least one of the following, remove a portion of the outer surface of the workpiece (e.g., abrading), remove debris (including unwanted material such as dirt, oil, grease and the like) from the outer surface of the workpiece (e.g., cleaning), or reduce the surface finish (i.e., scratch depth) in the workpiece (e.g., polishing or buffing).

The present invention can be used to refine a wide range of workpiece surfaces. These workpiece surfaces include metal (including mild steel, carbon steel, stainless steel, gray cast iron, titanium, aluminum and the like), metal alloys (copper, brass and the like), exotic metal alloys, ceramics, glass, wood (including pine, oak, maple, elm, walnut, hickory, mahogany, cherry and the like), wood like materials (including particle board, plywood, veneers and the like), composites, painted surface, plastics (including thermoplastics and reinforced thermoplastics), stones (including jewelry, marble, granite, and semi precious stones), magnetic media, and the like. Additional examples of glass workpieces include glass television screens, eye glass lenses, glass ophthalmic surfaces, windows (including home windows, office windows, car windows, air windows, train windows, bus windows and the like), glass display shelves, mirrors and the like.

The workpiece may be flat or may have a shape or contour associated with it. More examples of specific workpieces include metal engine components (including cam shafts, crankshafts, engine blocks and the like), hand tools metal forgings, fiber optic polishing, caskets, furniture, wood cabinets, turbine blades, painted automotive components, magnetic media (including rigid disc texturing, floppy discs and the like) and the like.

Depending upon the particular refining application, the force at the abrading interface can range from about 0.01 kg to over 100 kg, typically between 0.1 to 10 kg. Also depending upon the application, there may be a liquid present at the interface between the abrasive article or the loose particles and the workpiece outer surface. This liquid can be water and/or an organic solvent. The liquid may further comprise additives such as lubricants, rust inhibitors, coupling agents, anti-foams, anti-bacterial compounds, degreasing compounds, oils, grinding aids, emusilified organic compounds, cutting fluids, soaps, waxes, combinations thereof and the like. The abrasive article may oscillate at the refining interface during use.

The abrasive article can be used by hand or used in combination with a machine. For example, the abrasive article may be secured to a random orbital tool or a rotary tool. At least one or both of the abrasive article and the workpiece outer surface is moved relative to the other.

The coated or nonwoven abrasive article may be converted into any form such as sheet, disc, continuous length roll, belt and the like. If the abrasive article does move relative to the workpiece, then the abrasive article can move in any desired fashion and this depends largely in part upon the particular refining application. For example, the abrasive article can transit in a back and forth fashion, rotary fashion, circular fashion, spiral fashion, elliptical fashion or a random motion fashion. Additionally the abrasive article can oscillate and/or vibrate during polishing.

It is also within the scope of this invention for the workpiece outer surface to remain stationary during refining or alternatively, the workpiece outer surface may move relative to the abrasive article during refining. If the workpiece outer surface does move relative to the abrasive article, then the abrasive article can move in any desired fashion and this depends largely in part upon the particular refining application. For example, the workpiece outer surface can transit in a back and forth fashion, rotary fashion, circular fashion, spiral fashion, elliptical fashion or a random motion fashion. Additionally the workpiece outer surface can oscillate and/or vibrate during refining.

It is also within the scope of this invention that the precisely shaped particles may be used as a sandblasting media. In this aspect, these particles are projected (at relatively high speeds) at the outer surface of the workpiece. The precisely shaped particles may consist essentially of only binder. Alternatively the precisely shaped particles may further comprise abrasive grits, fillers, grinding aids, lubricants or combinations thereof.

Additionally, it is within the scope of this invention to use the precisely shaped particles in a traction control or slip resistant article. For example, the precisely shaped particles may be bonded to a backing and the resulting traction control article is secured to a floor, stair(s), step(s), deck, computer mouse pad, walkway, ramp, catwalk, mat and the like. The traction control article may be secured either by a pressure sensitive adhesive, a removable adhesive, hook and loop attachment or by a permanent adhesive. In this mode, this traction control article does appreciably refine the surface that comes into contact with the precisely shaped particles, but rather the traction control article typically provides an increased coefficient of friction to reduce any potential slippage. It is also feasible that the traction control article essentially have a similar construction to a coated abrasive article, i.e., a make and size coats. Alternatively, the precisely shaped particles may be mixed into an adhesive (preferably a flowable adhesive) and this resulting composition is applied or coated to a floor, stair(s), step(s), deck, computer mouse pad, walkway, ramp, catwalk, mat and the like. After this traction control composition is applied to a surface, the adhesive is solidified to form the traction control article. The precisely shaped particles to be used in a traction control article may consist essentially of only binder. Alternatively the precisely shaped particles may further comprise abrasive grits, fillers, lubricants or combinations thereof. The traction control article containing the precisely shaped particles may be used in indoor or outdoor applications.

It is also within the scope of this invention to use the precisely shaped particles in a filament or a bristle. The bristle will typically have a diameter from about 15 to 2500 micrometers, typically between about 25 to 2000 micrometers and preferably between 50 to 1500 micrometers. The bristle may have an aspect ratio greater than about one, preferably greater than about 5 and more preferably greater than about 10. A plurality of these bristles are then fabricated together to form a brush. This brush may be a flat brush or a rotary brush. Examples of brush configurations are further described in U.S. Pat. Nos. 3,924,286; 4,627,127 and 5,016,311. These bristles may include the precisely shaped particles, with or without abrasive grits in these particles. Relative to a bristle, it is preferred that the particle size of the precisely shaped particle be less than about 50 micrometers, preferably less than about 25 micrometers. The bristle may be extruded or injection molded. A particularly preferred brush construction comprises a flexible base having a plurality of unitary bristles. The brush is injection molded thermoplastic material.

Various modifications and alterations of this invention will become apparent to those skilled in the art without departing from the scope and spirit of this invention, and it should be understood that this invention is not to be unduly limited to the illustrative embodiments set forth herein.

The following non-limiting examples will further illustrate the invention. All parts, percentages, ratios, etc., in the examples are by weight unless indicated otherwise.

The following abbreviations and trade names described-below in Table 1 were used throughout the examples.

TABLE 1

Material Designations

| Designation | Material |
|---|---|
| TMPTA | trimethylolpropane triacrylate commercially available from Sartomer, Exton, PA. under the trade designation "Sartomer 351" |
| TATHEIC | triacrylate of tris(hydroxy ethyl) isocyanurate commercially available from Sartomer, Exton, PA. under the trade designation "Sartomer 368" |
| PH1 | 2-benzyl-2-N,N-dimethylamino-1-(4-morpholinophenyl)-1-butanone, commercially available from Ciba Geigy Company under the trade designation "IRGACURE 369" |
| $KBF_4$ | Potassium tetrafluoroborate grinding aid particulate having an average particle size of about 10 micrometers |
| CRY | Sodium aluminum fluoride grinding aid particulate commercially available from Washington Mills |
| CAO1 | Ceramic aluminum oxide abrasive grain comprising alpha alumina magnesia and rare earth oxide modifiers, commercially available from 3M Company, St. Paul, MN. under the trade designation "321 Cubitron" abrasive grain |
| MSCA | 3-methacryloxypropyl-trimethoxy silane coupling agent, commercially available from Union Carbide Corp. under the trade designation "A-174" |
| ASF | amorphous silica particles having an average surface area of 50 $m^2/g$, commercially available from DeGussa Corp. (Richfield Part, NJ), under the trade designation "OX-50" |

TABLE 1-continued

| Material Designations | |
|---|---|
| Designation | Material |
| PVC | polyvinylchloride, commercially available from Geon Company, Cleveland, Ohio under the trade designation "Geon 103EPF-76" |
| PETA | pentaerythritol triacrylate commercially available from Sartomer, Exton, PA. under the trade designation "Sartomer 444" |
| RPR1 | a resole phenolic resin having 74% solids in water/2-ethoxyethanol, sodium hydroxide catalyzed and approximately 2,000 centipoise viscosity at 25 C |
| RPR2 | a resole phenolic resin having 74% solids in water, potassium hydroxide catalyzed and approximately 2,000 centipoise viscosity at 25 C |
| PH2 | 2,2-dimethoxy-1-2-diphenyl-1-ethanone, commercially available from Ciba Geigy Company under the trade designation "Irgacure 651" |
| BAO | grade 180 brown fused aluminum oxide abrasive grit from Villach, Austria |
| GUAM | a glycoluril acrylamide resin having pendant alpha, beta unsaturated carbonyl groups; this material was made in a manner similar to that described in U.S. Pat. No. 5,055,113 Prepation 5 |
| DAP | diacryloyloxyethylphthalate; this material was made in a manner similar to that described in U.S. Pat. No. 3,336,418 |
| NPGDA | neopentyl glycol diacrylate commercially available from Sartomer, Exton, PA. Under the trade designation "Sartomer 247" |
| Q2 | an antifoam commercially available from Dow Corning under the trade designation "Q2" |
| $CACO_3$ | calcium carbonate filler having an average particle size of about 15 micrometers |
| $CASIO_3$ | calcium silicate filler having an average particle size of 18 micrometers |
| WA | a wetting agent commercially available from Byk Chemie USA, Wallingford, CT under the trade designation "Disperbyk 111" |

The precisely shaped particles were made according to one of the general procedures described below. These precisely shaped particles were incorporated into a coated abrasive article according to the General Procedure For Making a Coated Abrasive Article described below. The abrasive articles were tested according to one of the test procedures described below.

General Procedure I for Preparing Precisely Shaped Particles

The precisely shaped particles were prepared on the apparatus similar to that illustrated in FIG. 8, except that an ultrasonic horn was installed on the back side of the carrier web. A production tool was provided, in a continuous web form, that comprised a series of cavities with specified dimensions. These cavities were arranged in a predetermined order or array such that the production tool was essentially the inverse of the desired shape and dimensions of the precisely shaped particles. The production tool was made from a polypropylene thermoplastic material that had been previously embossed by extruding the polypropylene material over a master tool. The nickel master tool also contained a series of cavities with specified dimensions and shape. The nickel master tool was made via a cutting knurl process. The production tool had a pattern of cavities in the form of pyramids having square bases and disposed such that the bases were butted up against each other. The height of the pyramid was about 560 micrometers and the base length of each side of the base was about 1490 micrometers. The surface of the production tool containing the cavities is similar to the segment of the production tool shown in FIG. 6.

As the production tool left the unwind station at a tension of about 30 psi, a 51 micrometer thick polyester film carrier web left a second unwind station. The polyester film contained an ethylene acrylic acid copolymer primer. A binder precursor was applied by means of a knife over roll coater with a fixed gap of about 51 micrometer into the cavities of the production tool. The portion of the production tool containing the binder precursor was brought into contact with the carrier web by means of a nip roll that had a nip pressure of about 60 psi. The portion of the production tool containing the binder precursor and the carrier web was forced against a mandrel that rotated about an axis. Next, radiation energy was transmitted through the production tool and into the binder precursor. The source of the radiation energy was four ultraviolet lamps commercially available from Fusion, Inc. that contained a "D" bulb and operated at 600 Watts/inch (240 watts/cm). Upon exposure to the energy source, the binder precursor was converted into a solidified, handleable binder. Both the production tool containing the solidified, handleable binder and the carrier web were continuously moved through the curing zone by means of the mandrel. The carrier web was separated from the production tool containing the binder in the vicinity of a nip roll. An ultrasonic horn (Model number 108 commercially available from Branson) was placed directly behind the carrier web. The ultrasonic horn operated on high and helped to facilitate the removal of the particles from the carrier web. Next, the carrier web was rewound on a rewind station at a tension pressure of about 100 psi. This was a continuous process that operated at about 130 feet per minute (40 meters/minute) to 180 feet per minute (55 meters/minute).

These particles were removed from the carrier web in a combination two manners, i.e., as discrete particles or as a sheet of particles. These discrete particles also included doublets or triplets of individual particles. It was preferred to remove the particles as discrete particles. If 25% or less than the particles were removed from the carrier web as sheets of particles, then the resulting particles (including discrete particles and particle sheets) were first screened to separate the discrete particles from the particle sheets Then the particle sheets were ball milled in a cement mixer using steel or ceramic slugs. The slugs were one inch (2.54 cm) long by three quarter inch (1.9 cm) diameter. Care was taken during ball milling to avoid damage to the discrete particles. After ball milling, the particles were screened a second time. If about 25% or more of the particles were removed from from the carrier web as sheets of particles, then the resulting particles were ball milled in a manner similar to that described above. After ball milling the particles were screened.

General Procedure II for Preparing Precisely Shaped Particles

The precisely shaped particles were prepared in a manner similar to General Procedure I for Preparing Precisely Shaped Particles except for the following the changes. The process was conducted at 50 feet per minute (15 meters/minute) and there was only one ultraviolet lamp.

General Procedure III for Preparing Precisely Shaped Particles

The precisely shaped particles were prepared in a manner similar to General Procedure II for Preparing Precisely Shaped Particles except that the dimensions of the cavities were different. The height of the pyramid was about 330 micrometers and the base length of each side of the base was about 860 micrometers.

General Procedure IV for Preparing Precisely Shaped Particles

The precisely shaped particles were prepared in a manner similar to General Procedure I for Preparing Precisely Shaped Particles except that there were two ultraviolet lamps and both lamps operated at 600 Watts/inch (240 Watts/cm).

General Procedure V for Preparing Precisely Shaped Particles

The precisely shaped particles were prepared in a manner similar to General Procedure IV for Preparing Precisely Shaped Particles except that the dimensions of the cavities were different. The height of the pyramid was about 330 micrometers and the base length of each side of the base was about 860 micrometers.

General Procedure VI for Preparing Precisely Shaped Particles

The precisely shaped particles were prepared in a manner similar to General Procedure IV for Preparing Precisely Shaped Particles except that the dimensions of the cavities were different. The length of the base of the pyramid was about 1384 micrometers with equalaterial sides of about 1295 micrometers and the height of the pyramid was about 530 micrometers. This type of pattern is illustrated in FIG. 1 of U.S. Pat. No. 5,152,917. Additionally, the master tool was made via a diamond turning process and not a cutting knurl process.

General Procedure VII for Preparing Precisely Shaped Particles

The precisely shaped particles were prepared in a manner similar to General Procedure I for Preparing Precisely Shaped Particles except for the following the changes. The dimensions of the cavities were changed such that the length of the base of the pyramid was about 706 micrometers and the height of the pyramid was about 240 micrometers. Additionally, only two ultraviolet lamps were employed and the run speed was increased to 250 feet per minute (76 meters/minute).

General Procedure I for Preparing Coated Abrasive Articles

The grinding aid precisely shaped particles were incorporated into a coated abrasive disc having a backing made of vulcanized fibre. These fibre discs were individually made and had a diameter of 17.8 cm with a center hole having a diameter of 2.2 cm. The make coat was a conventional calcium carbonate filled resole phenolic resin (48% resin, 52% $CaCO_3$). The precisely shaped particles were first drop coated into the make coat precursor. Next, grade 50 CAO1 abrasive grits were electrostatically coated over the grinding aid particles and into the make coat at a weight of about 14 grams/disc. The resulting construction was heated for about 90 minutes at about 88° C. to partially cure the resole phenolic resin. Next, a size coat was brushed over the abrasive grits/precisely shaped particles layer. The size coat was also a conventional cryolite filled resole phenolic resin (32% resin, 68% cryolite). The resulting construction was heated for about 90 minutes at 93° C. and then 12 hours at 100° C. to fully cure the resole phenolic resin. The wet make coat weight was approximately four grams/disc and the wet size coat weight was approximately nine to ten grams/disc. The fibre discs were flexed prior to testing and humidified for 7 days at 45% relative humidity.

General Procedure II for Preparing Coated Abrasive Articles

The grinding aid precisely shaped particles were incorporated into a coated abrasive disc having a backing made of vulcanized fibre. These fibre discs were individually made and had a diameter of 17.8 cm with a center hole having a diameter of 2.2 cm. The make coat was a conventional calcium carbonate filled resole phenolic resin (48% resin, 52% $CaCO_3$). The precisely shaped particles were first drop coated into the make coat precursor. Next, CAO1 abrasive grits were electrostatically coated over the grinding aid particles and into the make coat. The resulting construction was heated for about 90 minutes at about 88° C. to partially cure the resole phenolic resin. Next, a size coat was brushed over the abrasive grits/precisely shaped particles layer. The size coat was also a conventional cryolite filled resole phenolic resin (32% resin, 68% cryolite). The resulting construction was heated for about 90 minutes at 93° C. and then 12 hours at 100° C. to fully cure the resole phenolic resin. Following this a conventional potassium tetrafluoroborate filled epoxy resin supersize was coated over the size coat and subsequently cured. The coating weights for the make coat, size coat and supersize coat were conventional coating weights for the particular grade of CAO1.

General Procedure III for Preparing Coated Abrasive Articles

The precisely shaped abrasive particles were incorporated into a coated abrasive article. The method to make the coated abrasive article was done a continuous basis and the resulting web of coated abrasive was converted into an endless, spliced abrasive belt The backing was a conventional Y weight polyester backing with a sateen weave. This cloth backing was conventionally treated with phenolic and phenolic/latex cloth treatments to enhance the physical characteristics of the backing. A make coat precursor was applied to the front surface of the backing. The make coat was a conventional calcium carbonate filled resole phenolic resin (48% resin, 52% $CaCO_3$) and the make coat coating weight was 290 grams/square meter. The precisely shaped abrasive particles were drop coated into the make coat precursor. The resulting construction was heated for about 60 minutes at about 96° C. to partially cure the resole phenolic resin. Next, a size coat was coated over the abrasive particles. The size coat was also a conventional cryolite filled resole phenolic resin (48% resin, 52% cryolite). The resulting construction was heated for about 120 minutes at 93° C. and then 10 hours at 107° C. to fully cure the resole phenolic resin. The resulting coated abrasive articles were flexed prior to testing.

General Procedure IV for Preparing Coated Abrasive Articles

The precisely shaped abrasive particles were incorporated into a coated abrasive article. The method to make the coated abrasive article was done a continuous basis and the resulting web of coated abrasive was converted into an endless, spliced abrasive belt. The backing was a conventional Y weight polyester backing with a sateen weave. This cloth backing was conventionally treated with phenolic and phenolic/latex cloth treatments to enhance the physical characteristics of the backing. A make coat precursor was applied to the front surface of the backing. The make coat was a conventional calcium carbonate filled resole phenolic resin (48% resin, 52% $CaCO_3$) and the make coat wet coating weight was approximately 290 grams/square meter. Next, approximately 440 grams of grade 36 brown fused aluminum oxide was drop coated into the make coat precursor. Following this, approximately 450 grams/square meter of grade 36 CAO1 were electrostatically coated over the brown aluminum oxide. The resulting construction was heated for about 90 minutes at about 88° C. to partially cure the resole phenolic resin. Next, a size coat was coated over the abrasive grits. The size coat was also a conventional calcium carbonate filled resole phenolic resin (48% resin, 52% calcium carbonate) at a wet weight of approximately 380 grams/square meter. After the size coat precursor was applied, the precisely shaped grinding aid particles were drop coated into the wet size coat precursor. The resulting construction was heated for about 120 minutes at 93° C. and then 10 hours at 100° C. to fully cure the resole phenolic resin. The resulting coated abrasive articles were flexed prior to testing.

Test Procedure I

The coated abrasive disc was first mounted on a beveled aluminum back-up pad and then used to grind the face of a 1.25 cm by 18 cm 1018 mild steel workpiece. The disc was driven at 5,500 rpm at no load while the portion of the disc overlaying the beveled edge of the back-up pad contacted the workpiece at a load of about 5.9 kg. The coated abrasive disc contacted the workpiece at angle between 6 to 7 degrees. Each disc was used to grind a separate workpiece for one minute intervals for a total grinding time of 10 minutes. The amount of metal removed (i.e. total cut) during the entire test was measured. There were two coated abrasive discs tested per example.

Test Procedure II

The coated abrasive material was attached to the periphery of a 36 cm metal wheel. The effective cutting area of the abrasive segment was 2.54 cm by 109 cm. This grinding process used was a conventional surface grinding wherein the workpiece was reciprocated beneath the rotating contact wheel with incremental downfeeding between each cycle. The grinding was done under a water flood. The workpiece abraded by these segments was 1018 steel, 1.27 cm width by 36 cm length by 7.6 cm height. Abrading was conducted along the 1.27 cm by 36 cm face. The metal wheel speed was 5830 surface feet per minute (1780 surface meters/minute). The table speed, at which the workpiece traversed, was 20 feet/minute (6 meters/minute). The downfeed increment of the wheel was 0.0127 mm/pass of the workpiece. The cross feed was 0.45 inch/pass (1.14 cm/pass).

Test Procedure III

The coated abrasive was converted into 7.6 cm by 335 cm endless belt and tested on a constant load surface grinder. A pre-weighed, 304 stainless steel workpiece approximately 2.5 cm by 5 cm by 18 cm was mounted in a holder. The workpiece was positioned vertically, with the 2.5 cm 18 cm face facing an approximately 36 cm diameter 65 Shore A durometer serrated rubber contact wheel with one on one lands over which was entrained the coated abrasive belt. The workpiece was then reciprocated vertically through an 18 cm path at the rate of 20 cycles per minute, while a spring loaded plunger urged the workpiece against the belt with a load of 11.3 kg as the belt was driven at about 2050 meters per minute. After one minute elapsed grinding time, the workpiece holder assembly was removed and re-weighed, the amount of stock removed calculated by subtracting the abraded weight from the original weight, and a new, pre-weighed workpiece and holder were mounted on the equipment. The test endpoint was 40 minutes.

Test Procedure IV

An endless coated abrasive belt (7.6 cm by 335 cm) was installed on a constant load surface grinder. The belt rotated over a 51 cm (20 inch) diameter aluminum contact wheel and an idler wheel at about 2580 surface meters per minute. The workpiece being abraded was a 304 stainless steel rod, which had a 1.9 cm diameter face and was about 30 cm long. The face of the rod was forced into the abrasive belt at a rate of 0.18 cm/second for 5 seconds. The test endpoint was when the coated abrasive dulled, i.e., the coated abrasive did not substantially abraded the workpiece.

Test Procedure V

The abrasive article was converted into a 203 cm by 6.3 cm endless belt and was installed on a Thompson grinding machine. The effective cutting area of the abrasive belt was 203 cm by 2.54 cm The workpiece was 304 stainless steel, 2.54 cm width by 17.78 cm length by 10.2 cm height and was mounted on a reciprocating table. Abrading was conducted along the 2.54 by 17.78 cm face. The abrading process used was conventional surface grinding wherein the workpiece was reciprocated beneath the rotating abrasive belt with incremental downfeed between each pass. The abrading conditions were: approximately 254 micrometers downfeed, 7.6 meters/minute table speed, and a belt speed of about 1710 surface meters/second. Between two consecutive passes underneath the abrasive belt, the workpiece was cooled with a water spray (with 1% rust inhibitor). The test endpoint was when the abrasive belt was no longer effectively cutting.

EXAMPLES 1 THROUGH 6 AND COMPARATIVE EXAMPLE A

This set of examples compared the abrading performance of a coated abrasive article (Examples 1 through 6) containing precisely shaped grinding aid particles to a coated abrasive article (Comparative Example A) that did not contain precisely shaped grinding aid particles. The precisely shaped grinding aid particles were made according to General Procedure I for Making Precisely Shaped Particles, except for the following changes. For examples 1 through 3, the primed polyester film was exposed to a corona source that operated at 20% power prior to coming in contact with the grinding aid precursor composition. The grinding aid slurries were prepared by first mixing together using a high shear mixer the TMPTA, TATHEIC, PHI, MSCA and ASF in the amounts (in parts) listed below in Table 2. Next, the grinding aid (either $KBF_4$ or CRY) was gradually added the binder precursor to for the grinding aid slurries. Also included in Table 2, was the amount (in grams/disc) of precisely shaped grinding aid particles that were incorporated into the coated abrasive article.

TABLE 2

Formulations of Grinding Aid Slurries for Examples 1 Through 6

| Material | Ex. 1 | Ex. 2 | Ex. 3 | Ex. 4 | Ex. 5 | Ex. 6 |
|---|---|---|---|---|---|---|
| TMPTA | 50 | 50 | 50 | 70 | 70 | 70 |
| TATHEIC | 50 | 50 | 50 | 30 | 30 | 30 |
| PH1 | 1 | 1 | 1 | 1 | 1 | 1 |
| MSCA | 1 | 1 | 1 | 1 | 1 | 1 |
| ASF | 1 | 1 | 1 | 1 | 1 | 1 |

TABLE 2-continued

| Formulations of Grinding Aid Slurries for Examples 1 Through 6 | | | | | | |
|---|---|---|---|---|---|---|
| Material | Ex. 1 | Ex. 2 | Ex. 3 | Ex. 4 | Ex. 5 | Ex. 6 |
| $KBF_4$ | 0 | 0 | 0 | 49 | 49 | 49 |
| CRY | 50.6 | 50.6 | 50.6 | 0 | 0 | 0 |
| Amount of grinding aid particles | 2 | 5 | 7 | 2 | 5 | 7 |

The coated abrasive articles for Examples 1 through 6 were made according to General Procedure I for Making the Coated Abrasive Article. The coated abrasive article for Comparative Example A was made according to General Procedure I for Making the Coated Abrasive Article except that the article did not contain precisely shaped grinding aid particles.

The resulting coated abrasive articles were tested according to Test Procedure I and the test results can be found in Table 3.

TABLE 3

| Test Procedure I Examples 1 through 6 and Comparative Example A | | |
|---|---|---|
| Example | Initial Cut (grams) | Total Cut (grams) |
| 1 | 44.6 | 146.9 |
| 2 | 45.1 | 195 |
| 3 | 44.3 | 221 |
| 4 | 44.1 | 136.9 |
| 5 | 50.4 | 197.8 |
| 6 | 48.4 | 208.5 |
| A | 32.7 | 111.8 |

It can be seen from the above data, that the addition of the precisely shaped particles improved the abrading characteristics of the coated abrasive discs.

Note that the initial cut was the amount of stainless steel removed in the first sixty seconds of grinding. These cut values were an average of two coated abrasive discs.

EXAMPLES 7 THROUGH 13 AND COMPARATIVE EXAMPLES B THROUGH E

This set of examples compared the abrading performance of a coated abrasive article (Examples 7 through 13) containing precisely shaped grinding aid particles to a coated abrasive article (Comparative Examples B through E) that did not contain precisely shaped grinding aid particles. Relative to Examples 7, 8, 10, 11 and 12 the precisely shaped particles were made according to General Procedure II for Making Precisely Shaped Particles. Relative to Examples 9 and 13 the precisely shaped particles were made according to General Procedure III for Making Precisely Shaped Particles. The grinding aid slurries were prepared by first mixing together using a high shear mixer the 1700 grams of TMPTA, 30 grams of ASF, 60 grams of MSCA, 1350 grams of $KBF_4$, 1550 grams of PVC and 22.5 grams of PH1. The coated abrasive articles for Examples 7 through 13 were made according to General Procedure II for Making the Coated Abrasive Article. The coated abrasive article for Comparative Examples B through E were made according to General Procedure II for Making the Coated Abrasive Article except that the article did not contain precisely shaped grinding aid particles. The grade of the CAO1, amount (in grams/disc) of precisely shaped grinding aid particle and the amount (in grams/disc) of the CAO1 for example is listed

TABLE 4

| Amount of Materials for Examples 7 through 13 and Comparative Examples B through E | | | |
|---|---|---|---|
| Example | Grade of CAO1 | grinding aid particle (grams/disc) | CAO1 (grams/disc) |
| B | 24 | 0 | 36 |
| 7 | 24 | 5 | 23.5 |
| 8 | 24 | 2.5 | 20.5 |
| C | 36 | 0 | 20 |
| 9 | 36 | 12 | 4 |
| D | 50 | 0 | 21 |
| 10 | 50 | 2.5 | 20 |
| 11 | 50 | 5 | 14.2 |
| 12 | 50 | 7.5 | 12.2 |
| E | 80 | 0 | 19.5 |
| 13 | 80 | 5 | 15 |

The resulting coated abrasive articles were tested according to Test Procedure I and the test results can be found in Table 5.

TABLE 5

| Test Procedure I Examples 7 through 13 and Comparative Examples B through E | |
|---|---|
| Example | Total Cut (grams) |
| B | 264 |
| 7 | 302 |
| 8 | 320 |
| C | 121 |
| 9 | 333 |
| D | 157 |
| 10 | 196 |
| 11 | 235 |
| 12 | 255 |
| E | 115 |
| 13 | 120 |

It can be seen from the above data, that the addition of the precisely shaped particles improved the abrading characteristics of the coated abrasive discs.

EXAMPLES 14 THROUGH 28

This set of examples compared the abrading performance of a coated abrasive article (Examples 14 through 29) containing precisely shaped abrasive particles of various binder compositions. Listed below in Table 6 are the abrasive slurry formulations (the amounts are listed in parts by weight) that were used to prepare the precisely shaped abrasive particles. The precisely shaped abrasive particles were made according to a procedure listed in Table 7. The precisely shaped abrasive particles were incorporated into a coated abrasive article according to General Procedure III for Making the Coated Abrasive. The precisely shaped abrasive particle weight and size coat weight for a given example is also listed in Table 7.

TABLE 6

| Abrasive Slurry Formulations for Examples 14 through 28 | | | | | |
|---|---|---|---|---|---|
| Material | Ex. 14, 15, 16 | Ex. 17, 18 | Ex. 19 | Ex. 20 | Ex. 21 |
| TATHEIC | 516 | 0 | 0 | 0 | 0 |
| TMPTA | 1204 | 1720 | 1720 | 0 | 0 |
| PH2 | 20 | 20 | 20 | 20 | 20 |
| MSCA | 60 | 60 | 60 | 60 | 60 |
| ASF | 30 | 60 | 60 | 20 | 20 |
| CRY | 1200 | 1200 | 0 | 1200 | 0 |
| BAO | 4000 | 4120 | 4120 | 3800 | 3800 |
| $KBF_4$ | 0 | 0 | 1200 | 0 | 0 |
| GUAM | 0 | 0 | 0 | 860 | 860 |
| DAP | 0 | 0 | 0 | 516 | 516 |
| NPGDA | 0 | 0 | 0 | 344 | 344 |
| Q2 | 0 | 0 | 0 | 1.5 | 1.5 |
| $CACO_3$ | 0 | 0 | 0 | 0 | 1200 |
| $CASIO_3$ | 0 | 0 | 0 | 0 | 0 |

| Material | Ex. 22 | Ex. 23 | Ex. 24 | Ex. 25, 26 | Ex. 27, 28 |
|---|---|---|---|---|---|
| TATHEIC | 0 | 0 | 0 | 0 | 0 |
| TMPTA | 0 | 0 | 0 | 0 | 0 |
| PH2 | 20 | 26 | 26 | 26 | 26 |
| MSCA | 60 | 60 | 60 | 60 | 60 |
| ASF | 20 | 0 | 0 | 0 | 0 |
| CRY | 0 | 0 | 0 | 0 | 0 |
| BAO | 3800 | 3600 | 3600 | 3500 | 3600 |
| WA | 0 | 0 | 0 | 1.5 | 1.5 |
| GUAM | 860 | 0 | 0 | 0 | 0 |
| DAP | 516 | 0 | 0 | 0 | 0 |
| NPGDA | 344 | 0 | 0 | 0 | 0 |
| PETA | 0 | 860 | 860 | 1190 | 860 |
| RPR1 | 0 | 0 | 0 | 689 | 1160 |
| RPR2 | 0 | 1160 | 1160 | 0 | 0 |
| Q2 | 1.5 | 1.5 | 1.5 | 1.5 | 1.5 |
| $CACO_3$ | 0 | 1200 | 0 | 0 | 0 |
| $CASIO_3$ | 1200 | 0 | 1200 | 1200 | 1200 |

TABLE 7

| Examples 14 through 28 | | | |
|---|---|---|---|
| Example | General Procedure for Making Abrasive Particle | Abrasive Particle weight in (grams/square inch) | Size Weight in (grams/ square inch) |
| 14 | IV | 0.53 | .25 |
| 15 | IV | 0.53 | .32 |
| 16 | IV | 0.53 | .42 |
| 17 | V | 0.35 | .27 |
| 18 | IV | 0.53 | .37 |
| 19 | IV | 0.53 | .299 |
| 20 | IV | 0.53 | .41 |
| 21 | IV | 0.53 | .42 |
| 22 | IV | 0.53 | .41 |
| 23 | IV | 0.53 | .42 |
| 24 | IV | 0.53 | .40 |
| 25 | V | 0.37 | .27 |
| 26 | VI | 0.44 | .30 |
| 27 | V | 0.37 | .26 |
| 28 | VI | 0.43 | .28 |

The coated abrasive belts were tested according to Test Procedure II and the test results can be found in Table 8. The total cut is listed in grams of metal removed.

TABLE 8

| Test Procedure II | |
|---|---|
| Example | Total Cut in grams |
| F | 400 |
| 14 | 120 |
| 15 | 142 |
| 16 | 190 |
| 17 | 211 |
| 18 | 180 |
| 19 | 108 |
| 20 | 155 |
| 21 | 135 |
| 22 | 156 |
| 23 | 185 |
| 24 | 310 |
| 25 | 268 |
| 26 | 367 |
| 27 | 265 |
| 28 | 304 |

EXAMPLES 29 THROUGH 31 AND COMPARATIVE EXAMPLE F

This set of Examples compared a coated abrasive that contained precisely shaped particles (Examples 29 through 31) with a coated abrasive that did not contain a precisely shaped particle. The precisely shaped particles of Example 29 were made according to General Procedure VII for Making Precisely Shaped Particles. The precisely shaped particles of Example 30 were made according to General Procedure VII for Making Precisely Shaped Particles, except that the dimensions of the cavities were changed. For example 30 and 31, the height of the pyramid was about 350 micrometers and the base length of each side of the base was about 1020 micrometers. The precisely shaped particles of Example 31 were processed at a slower speed, 150 feet per minute (46 meters per minute). The grinding aid slurries were prepared by first mixing together using a high shear mixer the TMPTA, TATHEIC, PHI, MSCA and ASF in the amounts (in parts) listed below in Table 9. Next, the grinding aid was gradually added the binder precursor to for the grinding aid slurries.

TABLE 9

| Formulations of Grinding Aid Slurries for Examples 29 Through 31 | | | |
|---|---|---|---|
| Material | Ex. 29 | Ex. 30 | Ex. 31 |
| TMPTA | 99.01 | 99.01 | 99.01 |
| PH1 | 0.99 | 0.99 | 0.99 |
| MSCA | 1 | 1 | 1 |
| ASF | 1 | 1 | 1 |
| KBF4 | 182 | 182 | 0 |
| CRY | 0 | 0 | 136 |

The coated abrasive for Example 29 was made according to General Procedure IV for Making the Coated Abrasive Article. For example 29, the weight of the grinding aid particle was approximately 230 grams/square meter.

The coated abrasive for Example 30 was made according to General Procedure IV for Making the Coated Abrasive Article, except for the following changes. The grinding aid particles were not drop coated into the size coat precursor. After the size coat precursor was cured, a supersize precursor coating was applied over the size coat. The supersize precursor coating was a conventional cryolite filled phenolic resin. The grinding aid particles were coated into the wet supersize precursor coating at a weight of approximately 180 grains/square meter. Next, the resulting construction was heated to cure the resin.

The coated abrasive for Example 31 was made according to General Procedure IV for Making the Coated Abrasive Article, except for the following changes. The grinding aid particles were not drop coated into the wet size coat. The grinding aid particles were drop coated into the make coat precursor at a weight of approximately 110 grams/square meter in place of the brown aluminum oxide abrasive grit. Additionally, a conventional supersize precursor coating was applied over the size coat and heated to cure the supersize precursor binder. The supersize precursor coating was a conventional potassium tetrafluoroborate filled solvent based epoxy resin.

The coated abrasive for Comparative Example F was made according to General Procedure IV for Making the Coated Abrasive Article, except for the following changes. The precisely shaped grinding aid particles were not drop coated into the wet size coat precursor Additionally, a conventional supersize precursor coating was applied over the size coat and heated to cure the supersize precursor binder. The supersize precursor coating was a conventional potassium tetrafluoroborate filled solvent based epoxy resin.

The resulting coated abrasives for Examples 29 through 31 and Comparative Example F were tested according to Test Procedures III, IV and V. The test results are listed in Tables 10, 11 and 12 respectively.

TABLE 10

Test Procedure III.
Examples 29 through 31 and Comparative Example F

| Example | Initial Cur (grams) | Final Cut (grams) | Total Cut (grams) |
|---|---|---|---|
| F | 113.44 | 8.68 | 1316.44 |
| 29 | 100.44 | 14.16 | 1612.88 |
| 30 | 102.72 | 14.13 | 1595.71 |
| 31 | 121.70 | 17.15 | 1910.44 |

TABLE 11

Test Procedure IV.
Examples 29, 30 and 31 and Comparative Example F

| Example | Total Cut (grams) |
|---|---|
| F | 681 |
| 29 | 499 |
| 30 | 555 |
| 31 | 626 |

TABLE 12

Test Procedure V.
Examples 29, 30 and 31 and Comparative Example F

| Example | Total Cut (grams) |
|---|---|
| F | 2664 |
| 29 | 2281 |
| 30 | 2574 |
| 31 | 2672 |

The above grinding data indicated that different levels of abrading performance could be achieved with different grinding conditions.

EXAMPLES 32 THROUGH 40

This set of examples demonstrated different grinding aid particulates that were incorporated into the precisely shaped grinding aid particle. The formulations of the compositions to form the precisely shaped grinding aid particles for this set of examples are listed in Table 13.

TABLE 13

Formulations of Grinding Aid Slurries for Examples 32 Through 40

| Material | Ex. 32 | Ex. 33 | Ex. 34 | Ex. 35 | Ex. 36 |
|---|---|---|---|---|---|
| TMPTA | 28 | 31 | 57 | 37 | 37 |
| PH1 | 0.57 | 0.8 | 0.58 | 0.74 | 0.74 |
| $KBF_4$ | 17.9 | 0 | 0 | 31.13 | 0 |
| CRY | 17.9 | 17.05 | 0 | 0 | 31.13 |
| FES* | 0 | 17.05 | 0 | 0 | 0 |
| PVC | 0 | 0 | 42.24 | 31.13 | 31.13 |

| Material | Ex. 37 | Ex. 38 | Ex. 39 | Ex. 40 |
|---|---|---|---|---|
| TMPTA | 29 | 99.01 | 99.01 | 99.01 |
| PH1 | 0.28 | 0.99 | 0.99 | 0.99 |
| $KBF_4$ | 0 | 182 | 182 | 182 |
| CRY | 70.72 | 0 | 0 | 0 |
| FES* | 0 | 0 | 0 | 0 |
| PVC | 0 | 0 | 0 | 0 |

*FES was an iron sulfide grinding aid ($FeS_2$).

The precisely shaped grinding aid particles for Examples 32 and 37 were made in the same manner as Example 31, except that the run speed was 100 feet per minute (30.5 meters/minute).

The precisely shaped grinding aid particles for Examples 33 were made in the same manner as Example 31, except that the run speed was 50 feet per minute (16 meters/minute).

The precisely shaped grinding aid particles for Examples 34, 35 and 36 were made in the same manner as Example 31, except that the run speed was 100 feet per minute (30.5 meters/minute). Additionally, the particles as they were removed from the carrier web tended to come off in sheets, rather than in discrete particles. These sheets were ball milled to convert the sheets into discrete particles.

The precisely shaped grinding aid particles for Examples 38 were made in the same manner as Example 29, except that the carrier web was 50 micrometer thick polyester film and the corona treater level was 25%. Additionally, the run speed was changed to 150 feet per minute (46 meters/minute).

The precisely shaped grinding aid particles for Examples 39 were made in the same manner as Example 30, except that the carrier web was 50 micrometer thick polyester film and the corona treater level was 25%. Additionally, the run speed was changed to 100 feet per minute (31 meters/minute).

The precisely shaped grinding aid particles for Examples 40 were made in the same manner as Example 39, except that the dimensions of the particles were different. The particles were square based pyramids that had a height of about 560 micrometers and the base length of each side was about 1490 micrometers.

What is claimed is:

1. A coated abrasive article, comprising:

(a) a backing having a front and back surface;

(b) a make coat present on the front surface of the backing, (c) a plurality of precisely shaped abrasive particles bonded to the front surface of the backing by means of said make coat, wherein the precisely shaped abrasive particles comprise a plurality of abrasive grits distributed in a binder, wherein the binder is formed from a binder precursor comprising a blend of a resole phenolic resin and a free radical curable resin, and wherein the resole phenolic resin is present in an amount of from 30 to 50 weight percent, based on the total weight of resole phenolic resin and free radical curable resin; and (d) a size coat present over the precisely shaped abrasive particles.

2. An abrasive article according to claim 1, wherein the abrasive grits are selected from the group consisting of fused aluminum oxide, ceramic aluminum oxide, heat treated aluminum oxide, silicon carbide, alumina zirconia, diamond, ceria, cubic boron nitride, garnet, and combinations thereof.

3. A coated abrasive according to claim 1, wherein the precisely shaped abrasive particles have a size ranging from about 0.1 to about 2500 micrometers.

4. A coated abrasive according to claim 1, wherein the precisely shaped abrasive particles have a size ranging from about 0.1 to about 500 micrometers.

5. A coated abrasive according to claim 1, wherein the precisely shaped abrasive particles have shapes selected from the group consisting of pyramids, cones, prisms, spheres, and ellipsoids.

6. A coated abrasive article according to claim 1, wherein the binder precursor further comprises a free radical initiator.

7. A coated abrasive article according to claim 1, wherein the precisely shaped abrasive particles further comprise at least one additive selected from the group consisting of fillers, fibers, antistatic agents, lubricants, wetting agents, surfactants, pigments, dyes, coupling agents, plasticizers, and suspending agents.

8. A coated abrasive article according to claim 1, wherein the precisely shaped abrasive particles comprise from 5 to 95% by weight abrasive grits and from 95 to 5% by weight binder.

9. A coated abrasive article according to claim 1, wherein the precisely shaped abrasive particles comprise from 25 to 75 percent by weight abrasive grits and from 25 to 75 percent by weight binder.

10. A coated abrasive article according to claim 1, wherein the make coat is selected from the group consisting of phenolic resins, epoxy resins, urea-formaldehyde resins, acrylate resins, acrylated epoxy resins, acrylated urethane resins, aminoplast resins having pendant alpha, beta unsaturated carbonyl groups, maleimide resins, and urethane resins.

11. A coated abrasive article according to claim 1, wherein the size coat is selected from the group consisting of phenolic resins, epoxy resins, urea-formaldehyde resins, acrylate resins, acrylated epoxy resins, acrylated urethane resins, aminoplast resins having pendant alpha, beta unsaturated carbonyl groups, maleimide resins, and urethane resins.

12. A coated abrasive article according to claim 1, wherein the backing is selected from the group consisting of paper, nonwoven substrates, polymeric film, cloth, vulcanized fiber, combinations thereof, and treated versions thereof.

13. A bonded abrasive article, comprising:

(a) a bonding medium;

(b) a plurality of precisely shaped abrasive particles wherein the precisely shaped abrasive particles comprise a plurality of abrasive grits distributed in a binder, wherein the binder is formed from a binder precursor comprising a blend of a resole phenolic resin and a free radical curable resin, and wherein the resole phenolic resin is present is an amount of from 30 to 50 weight percent, based on the total weight of resole phenolic resin and free radical curable resin; and wherein the bonding medium forms a shaped ass of the precisely shaped abrasive particles.

14. A bonded abrasive article according to claim 13, wherein the abrasive grits are selected from the group consisting of fused aluminum oxide, ceramic aluminum oxide, heat treated aluminum oxide, silicon carbide, alumina zirconia, diamond, ceria, cubic boron nitride, garnet, and combinations thereof.

15. A bonded abrasive according to claim 13, wherein the size of the precisely shaped abrasive particles have a size ranging from about 0.1 to about 2500 micrometers.

16. A bonded abrasive according to claim 13, wherein the size of the precisely shaped abrasive particles have a size ranging from about 0.1 to about 500 micrometers.

17. A bonded abrasive according to claim 13, wherein the precisely shaped abrasive particles have shapes selected from the group consisting of pyramids, cones, prisms, spheres, and ellipsoids.

18. A bonded abrasive article according to claim 13, wherein the binder precursor further comprises a free radical initiator.

19. A bonded abrasive article according to claim 13, wherein the precisely shaped abrasive particles further comprise at least one additive selected from the group consisting of fillers, fibers, antistatic agents, lubricants, wetting agents, surfactants, pigments, dyes, coupling agents, plasticizers, and suspending agents.

20. A bonded abrasive article according to claim 13, wherein the precisely shaped abrasive particles comprise from 5 to 95% by weight abrasive grits and from 95 to 5% by weight binder.

21. A bonded abrasive article according to claim 13, wherein the precisely shaped abrasive particles comprise from 25 to 75% by weight abrasive grits and from 25 to 75% by weight binder.

* * * * *

UNITED STATES PATENT AND TRADEMARK OFFICE

CERTIFICATE OF CORRECTION

PATENT NO. : 6,475,253 B2
DATED : November 5, 2002
INVENTOR(S) : Culler, Scott R.

It is certified that error appears in the above-identified patent and that said Letters Patent is hereby corrected as shown below:

Title page,
Item [56], U.S. PATENT DOCUMENTS, insert -- 4,652,275 A 3/87 Bloecher et al. 51/298 --.

Column 13,
Line 55, delete ")" following "ranging".

Column 17,
Line 22, insert -- . -- following "precursor".
Line 40, insert -- . -- following "tool".

Column 20,
Line 17, insert -- . -- following "thereof".

Column 23,
Line 40, insert -- . -- following "lubricants".

Column 34,
Line 40, insert -- . -- following "sheets".

Column 36,
Line 32, insert -- . -- following "belt".

Column 38,
Line 19, insert -- . -- following "cm".

Column 43,
Line 21, insert -- . -- following "precursor".

UNITED STATES PATENT AND TRADEMARK OFFICE

CERTIFICATE OF CORRECTION

PATENT NO. : 6,475,253 B2
DATED : November 5, 2002
INVENTOR(S) : Culler, Scott R.

It is certified that error appears in the above-identified patent and that said Letters Patent is hereby corrected as shown below:

Column 46,
Line 20, delete "ass" and insert in place therefor -- mass --.

Signed and Sealed this

First Day of July, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,475,253 B1
DATED : November 5, 2002
INVENTOR(S) : Culler, Scott R.

It is certified that error appears in the above-identified patent and that said Letters Patent is hereby corrected as shown below:

Title page,
Item [75], Inventors, "Culler, Scott R., Burnsville MN; Gagliardi, John J., Hudson WI; Larkey, Thomas W., Hugo MN; Larson, Eric G., Lake Elmo MN; Martin, Larry L., Maplewood MN; Nelson, Jeffrey W., Bayport MN"

should read -- Culler, Scott R., Burnsville MN; Gagliardi, John J., Hudson WI; Larson, Eric G., Lake Elmo MN; Nelson, Jeffrey W., Bayport MN --

Signed and Sealed this

Twelfth Day of October, 2004

JON W. DUDAS
*Director of the United States Patent and Trademark Office*